US007542007B2

(12) United States Patent
Yamaguchi et al.

(10) Patent No.: US 7,542,007 B2
(45) Date of Patent: Jun. 2, 2009

(54) ANTENNA, EARPHONE ANTENNA, AND BROADCASTING RECEIVER INCLUDING EARPHONE ANTENNA

(75) Inventors: Motofumi Yamaguchi, Osaka (JP); Eiji Suematsu, Nara (JP); Haruo Suzuki, Utsunomiya (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 12/029,347

(22) Filed: Feb. 11, 2008

(65) Prior Publication Data

US 2008/0198090 A1 Aug. 21, 2008

(30) Foreign Application Priority Data

Feb. 13, 2007 (JP) ..... 2007-032748

(51) Int. Cl.
*H01Q 1/50* (2006.01)

(52) U.S. Cl. ..... 343/859; 343/702; 333/202; 333/26

(58) Field of Classification Search ..... 343/859, 343/702, 718, 858, 860; 333/26, 202; 381/380
See application file for complete search history.

(56) References Cited

U.S. PATENT DOCUMENTS 4,654,883 A * 3/1987 Iwata ..... 381/380
6,806,836 B2 * 10/2004 Ogawa et al. ..... 343/702
7,483,727 B2 * 1/2009 Zhu et al. ..... 455/575.5

FOREIGN PATENT DOCUMENTS

JP 2005-64742 A 3/2005

* cited by examiner

*Primary Examiner*—HoangAnh T Le
(74) *Attorney, Agent, or Firm*—Birch, Stewart, Kolasch & Birch, LLP

(57) ABSTRACT

An antenna of the present invention includes a coaxial cable, antenna elements (3*a* and 3*b*), and an unbalanced/balanced converter. The unbalanced/balanced converter has a high-pass circuit provided between an input terminal port1 and an output terminal port2 and a low-pass circuit provided between the input terminal port1 and an output terminal port3. Moreover, the high-pass circuit rejects frequencies within a VHF band, and the high-pass circuit and the low-pass circuit both pass frequencies within a UHF band. In response to a signal, inputted to the input terminal port1, which falls within the UHF band, the high-pass circuit and the low-pass circuit output signals that are inverted in phase and equal in amplitude with respect to each other. Therefore, the antenna has high transmission and reception sensitivity in a wide frequency range, i.e., in the VHF and UHF bands. This makes it possible to provide an antenna having high transmission and reception sensitivity in a wide frequency range.

11 Claims, 14 Drawing Sheets

ANTENNA, EARPHONE ANTENNA, AND BROADCASTING RECEIVER INCLUDING EARPHONE ANTENNA

This Nonprovisional application claims priority under 35 U.S.C. § 119(a) on Patent Application No. 032748/2007 filed in Japan on Feb. 13, 2007, the entire contents of which are hereby incorporated by reference.

FIELD OF THE INVENTION

The present invention relates to antennas that transmit and receive radio waves. An antenna of the present invention exhibits good sensitivity in transmitting and receiving radio waves falling within a wide frequency range, and therefore can be widely applied as an antenna for use in transmission and reception of broadcast waves and the like. Further, the use of the antenna of the present invention, for example, as an earphone antenna makes it possible to enable a mobile television receiver or the like to receive broadcast waves with high sensitivity.

BACKGROUND OF THE INVENTION

The conventional analog television broadcasting uses a VHF band (88 MHz to 222 MHz). The ongoing transition from analog to digital broadcasting will cause a big change in band for use in television broadcasting.

That is, it has been decided that terrestrial digital broadcasting uses a UHF band (470 MHz to 710 MHz). After the end of analog broadcasting, the VHF band (88 MHz to 222 MHz) will be allotted to new broadcasting services.

Meanwhile, some small mobile terminals such as mobile phones have been prepared which can receive digital broadcasts such as digital radio broadcasts and digital television broadcasts, and such mobile terminals are becoming widespread. Further, there has been a tendency toward enrichment of broadcast content dedicated to mobile terminals such as one-segment mobile terminals. Therefore, mobile terminals are required to deal with a wide range of bands such as an FM radio band (75 MHz and a band located thereby), the VHF band, and the UHF band.

A conventional mobile terminal generally uses an earphone antenna as an antenna to receive such various broadcasts. The earphone antenna is used both as an earphone and an antenna. That is, the earphone antenna functions both as an earphone for outputting sounds and an antenna for receiving broadcast waves.

A typical earphone antenna includes a coaxial cable and an earphone cable. The coaxial cable includes a central conductor and an outer conductor that are insulated from each other. The earphone cable is a sound transmitting wire that serves also as a radiating element, and is connected to the coaxial cable. Generally, each of the coaxial cable and the earphone cable has a length of one-quarter resonant wavelength of an FM or VHF radio wave.

Moreover, when the coaxial cable and the earphone cable are fed with unbalanced power, the outer conductor of the coaxial cable and the earphone cable operate as a sleeve antenna suitable for reception of FM and VHF radio waves.

However, in cases where the length of each of the coaxial cable and the earphone cable is set to one-quarter resonant wavelength of a VHF broadcast wave, the coaxial cable and the earphone cable become much longer than the effective resonant length of a UHF broadcast wave. Therefore, the conventional earphone antenna has been low in reception sensitivity to UHF radio waves that are used for terrestrial digital broadcasting and the like.

In view of this, Patent Document 1 mentioned below discloses an earphone antenna having two earphone cables one of which has a length of one-quarter resonant wavelength of a UHF radio wave, thereby increasing reception sensitivity to UHF radio waves.

[Patent Document 1]

Japanese Unexamined Patent Application Publication No. 64742/2005 (Tokukai 2005-64742; published on Mar. 10, 2005)

However, even in cases where one of the earphone cables has a length of one-quarter resonant wavelength of a UHF radio wave, it is still difficult to obtain sufficient reception sensitivity.

This is, for example, because a typical coaxial cable has an outer conductor whose surface area is larger than the surface area of an earphone cable. That is, a leak current (unbalanced current) by which the large-surface-area outer conductor of the coaxial cable is excited becomes dominant over an electrical current flowing through the earphone cable.

With this, the influence of an electrical current flowing through the outer conductor of the coaxial cable which outer conductor has a length equal of one-quarter resonant wavelength of a VHF radio wave becomes greater than the influence of an electrical current flowing through the earphone cable that has a length of one-quarter resonant wavelength of a UHF radio wave.

Therefore, even in cases where the length of one of the earphone cables is set to one-quarter resonant wavelength of a UHF radio wave, the effect of setting the length of one of the earphone cables to one-quarter resonant wavelength of a UHF radio wave is cancelled by the influence of an electrical current flowing through the outer conductor of the coaxial cable. This makes it difficult to obtain sufficient sensitivity to broadcasts.

On the other hand, in cases where the length of each of the earphone cable and the coaxial cable is set to one-quarter wavelength of a UHF radio wave for the purpose of increasing reception sensitivity to UHF radio waves, the outer conductor of the coaxial cable and the earphone cable operate as a sleeve antenna suitable for reception of UHF radio waves. This makes it possible to increase reception sensitivity to UHF radio waves.

However, an earphone cable for use in the UHF band has a length as short as approximately a twentieth of one-quarter resonant wavelength of an FM or VHF radio wave. This undesirably causes remarkable deterioration in reception sensitivity in the FM and VHF bands.

Thus, there has conventionally been such a problem that it is impossible to realize an antenna that has good sensitivity in both the VHF and UHF bands.

SUMMARY OF THE INVENTION

The present invention has been made in view of the foregoing problems, and it is an object of the present invention to provide an antenna and an earphone antenna that have high reception sensitivity in a wide frequency range and a mobile terminal including the earphone antenna.

In order to solve the foregoing problems, an antenna of the present invention includes: an unbalanced power feeder line; first and second antenna elements; and an unbalanced/balanced converter which includes an input port and first and second output ports, the unbalanced power feeder line being connected to the input port, the first and second antenna elements being connected the first and second output ports, respectively, the unbalanced/balanced converter having a first filter circuit provided between the input port and the first output port and a second filter circuit provided between the input port and the second output port, the first filter circuit rejecting frequencies within a first frequency range, the first and second filter circuits passing frequencies within a second frequency range different from the first frequency range, in response to a signal, inputted to the input port, which falls within the second frequency range, the first and second filter circuits outputting signals that are inverted in phase and equal in amplitude with respect to each other.

According to the foregoing arrangement, an antenna input signal supplied from the unbalanced power feeder line is transmitted to the input port of the unbalanced/balanced converter. In cases where the antenna input signal is a signal that has a frequency falling within the first frequency range, the antenna input signal is outputted solely from the second output port since the first filter circuit rejects frequencies within the first frequency range.

Therefore, the second antenna element connected to the second output port and the unbalanced power feeder line are fed with unbalanced power. As a result, the second antenna element and the unbalanced power feeder operate as a sleeve antenna.

That is, in cases where the antenna of the present invention transmits and receives a radio wave falling within the first frequency range, the second antenna element and the unbalanced power feeder operate as a sleeve antenna. This makes it possible to efficiently transmit and receive a radio wave falling within the first frequency range.

On the other hand, in cases where the antenna input signal is a signal that has a frequency falling within the second frequency range, the antenna input signal is outputted from both the first and second output ports since the first and second filter circuits pass frequencies within the second frequency range. Moreover, the antenna input signal outputted from the first output port flows through both the first and second antenna elements.

The first and second filter circuits of the unbalanced/balanced converter output signals that are inverted in phase and equal in amplitude with respect to each other. That is, in cases where the antenna input signal is a signal that has a frequency falling within the second frequency range, the first and second antenna elements are fed with balanced power.

This causes resonance between an electrical current flowing through the first antenna element and an electrical current flowing through the second antenna element. As a result, the first and second antenna elements operate as a dipole antenna.

That is, in cases where the antenna of the present invention transmits and receives a radio wave falling within the second frequency range, the first and second antenna elements operate as a dipole antenna. This makes it possible to efficiently transmit and receive a radio wave falling within the second frequency range.

As described above, the antenna of the present invention operates as a sleeve antenna in transmitting and receiving a radio wave falling within the first frequency range and operates as a dipole antenna in transmitting and receiving a radio wave falling within the second frequency range. As a result, the antenna of the present invention has high transmission and reception sensitivity both in the first and second frequency ranges.

Further, the antenna of the present invention is preferably arranged such that each of the unbalanced power feeder line and the second antenna element has an effective length falling within a range of one-quarter wavelength of a lowest frequency in the first frequency range to one-quarter wavelength of a highest frequency in the first frequency range.

As described above, the unbalanced power feeder line and the second antenna element operate as a sleeve antenna at the time of transmission and reception of a radio wave falling within the first frequency range. Therefore, by setting each of the unbalanced power feeder line and the second antenna element to have an effective length falling within a range of one-quarter wavelength of the lowest frequency in the first frequency range to one-quarter wavelength of the highest frequency in the first frequency range, a radio wave falling within the first frequency range can be efficiently transmitted and received.

Further, the antenna of the present invention is preferably arranged such that each of the first and second antenna elements has an effective length falling within a range of one-quarter wavelength of a lowest frequency in the second frequency range to one-quarter wavelength of a highest frequency in the second frequency range.

As described above, the first and second antenna elements operate as a dipole antenna at the time of transmission and reception of a radio wave falling within the second frequency range. Therefore, by setting each of the first and second antenna elements to have an effective length falling within a range of one-quarter wavelength of the lowest frequency in the second frequency range to one-quarter wavelength of the highest frequency in the second frequency range, a radio wave falling within the second frequency range can be efficiently transmitted and received.

Further, the antenna of the present invention is preferably arranged such that while one of the unbalanced power feeder line and the second antenna element has an effective length of one-quarter wavelength of a lowest frequency in the first frequency range, the other one of the unbalanced power feeder line and the second antenna element has an effective length of one-quarter wavelength of a highest frequency in the first frequency range.

The foregoing arrangement makes it possible to use the unbalanced power feeder line and the second antenna element to efficiently transmit and receive all radio waves falling within the first frequency range from the lowest frequency to the highest frequency.

The antenna of the present invention is preferably arranged such that while one of the first and second antenna elements has an effective length of one-quarter wavelength of a highest frequency in the second frequency range, the other one of the first and second antenna elements has an effective length of one-quarter wavelength of a lowest frequency in the second frequency range.

The foregoing arrangement makes it possible to use the first and second antenna elements to efficiently transmit and receive all radio waves falling within the second frequency range from the lowest frequency to the highest frequency.

Further, in order to solve the foregoing problems, an earphone antenna of the present invention includes: a first earphone cable via which an audio signal is supplied to a first earphone; a second earphone cable via which an audio signal is supplied to a second earphone; a feeder cable via which an antenna input signal and an audio signal are supplied to the first and second earphone cables; and an unbalanced/balanced converter which includes an input port and first and second output ports, the unbalanced/balanced converter having a first filter circuit provided between the input port and the first output port and a second filter circuit provided between the input port and the second output port, the first filter circuit rejecting frequencies within a first frequency range, the first and second filter circuits passing frequencies within a second frequency range different from the first frequency range, in response to a signal, inputted to the input port, which falls within the second frequency range, the first and second filter circuits outputting signals that are inverted in phase and equal in amplitude with respect to each other, the feeder cable being connected to the input port, the first earphone cable being connected to the first output port, the second earphone cable being connected to the second output port.

According to the foregoing arrangement, an antenna input signal supplied from the feeder cable is transmitted to the input port of the unbalanced/balanced converter. In cases where the antenna input signal is a signal that has a frequency falling within the first frequency range, the antenna input signal is outputted solely from the second output port since the first filter circuit rejects frequencies within the first frequency range.

Therefore, the second earphone cable connected to the second output port and the feeder cable are fed with unbalanced power. Moreover, as a result, the second earphone cable and the feeder cable operate as a sleeve antenna.

That is, in cases where the earphone antenna of the present invention receives a radio wave falling within the first frequency range, the second earphone cable and the feeder cable operate as a sleeve antenna. This makes it possible to efficiently receive a radio wave falling within the first frequency range.

On the other hand, in cases where the antenna input signal is a signal that has a frequency falling within the second frequency range, the antenna input signal is outputted from both the first and second output ports since the first and second filter circuits both pass frequencies within the second frequency range. Moreover, the antenna input signal outputted from the first output port flows through both the first and second earphone cables.

The first and second filter circuits of the unbalanced/balanced converter output signals that are inverted in phase and equal in amplitude with respect to each other. That is, in cases where the antenna input signal is a signal that has a frequency falling within the second frequency range, the first and second earphone cables are fed with balanced power.

This causes resonance between an electrical current flowing through the first earphone cable and an electrical current flowing through the second earphone cable. As a result, the first and second earphone cables operate as a dipole antenna.

That is, in cases where the earphone antenna of the present invention receives a radio wave falling within the second frequency range, the first and second earphone cables operate as a dipole antenna. This makes it possible to efficiently receive a radio wave falling within the second frequency range.

As described above, the earphone antenna of the present invention operates as a sleeve antenna in receiving a radio wave falling within the first frequency range and operates as a dipole antenna in receiving a radio wave falling within the second frequency range. Therefore, the earphone antenna of the present invention has high reception sensitivity both in the first and second frequency ranges.

Further, the earphone antenna of the present invention is preferably arranged such that: while the first earphone cable includes positive and negative signal lines via which an audio signal is supplied to the first earphone, the second earphone cable includes positive and negative signal lines via which an audio signal is supplied to the second earphone; and while the positive and negative signal lines of the first earphone cable are connected to each other via a first capacitor that passes a high-frequency signal and blocks an audio signal, the positive and negative signal lines of the second earphone cable are connected to each other via a second capacitor that passes a high-frequency signal and blocks an audio signal.

According to the foregoing arrangement, an audio signal cannot pass through the first and second capacitors. Therefore, positive and negative audio signals transmitted to the first or second earphone cable are transmitted to the positive and negative signal lines, respectively.

Further, since the first and second capacitors pass a high-frequency signal, a high-frequency signal transmitted to the first or second earphone cable is transmitted to both the positive and negative signal lines.

Therefore, both the positive and negative signal lines via which audio signals are supplied operate as a sleeve antenna or a dipole antenna. This makes it possible to realize a more highly sensitive earphone antenna.

Further, the earphone antenna of the present invention is preferably arranged such that each of the first and second earphone cables is constituted by a coaxial cable.

In cases where each of the first and second earphone cables is constituted by a coaxial cable, there is a reduction in current density of high-frequency currents flowing through the first and second earphone cables. This is because the coaxial cable has an outer conductor whose conductive area is larger than the conductive area of a normal cable.

Therefore, the foregoing arrangement makes it possible to achieve a reduction in conductor loss of the first and second earphone cables, thereby bringing about an improvement in radiation efficiency. This makes it possible to increase the reception sensitivity of the earphone antenna.

Further, the earphone antenna of the present invention is preferably arranged such that: the feeder cable includes positive and negative signal lines via which an audio signal is supplied to the first earphone cable and positive and negative signal lines via which an audio signal is supplied to the second earphone cable; and while the positive and negative signal lines via which an audio signal is supplied to the first earphone cable are connected to each other via a third capacitor that passes a high-frequency signal and blocks an audio signal, the positive and negative signal lines via which an audio signal is supplied to the second earphone cable are connected to each other via a fourth capacitor that passes a high-frequency signal and blocks an audio signal.

According to the foregoing arrangement, an audio signal cannot pass through the third and fourth capacitors. Therefore, a positive audio signal, contained in an audio signal transmitted to the feeder cable, which is supplied to the first earphone cable is transmitted to the positive signal line, and a negative audio signal, contained in the audio signal transmitted to the feeder cable, which is supplied to the first earphone cable is transmitted to the negative signal line. Similarly, positive and negative audio signals transmitted to the second earphone cable are transmitted to the positive and negative signal lines, respectively.

Therefore, the foregoing arrangement makes it possible to deal with a differential audio signal and to output as a sound a high-quality audio signal transmitted in the form of the differential audio signal.

Further, the third and fourth capacitors pass a high-frequency signal. Therefore, a high-frequency signal transmitted to the feeder cable is transmitted to the positive and negative signal lines via which an audio signal is supplied to the first earphone cable and to the positive and negative signal lines via which an audio signal is supplied to the second earphone cable.

Therefore, the positive and negative signal lines via which an audio signal is supplied to the first earphone cable and the positive and negative signal lines via which an audio signal is supplied to the second earphone cable operate as a sleeve antenna. This makes it possible to further increase reception sensitivity in the first frequency range.

Further, the earphone antenna of the present invention is preferably arranged such that while the first frequency range is a frequency range of substantially 88 MHz to 222 MHz, the second frequency range is a frequency range of substantially 470 MHz to 710 MHz.

The foregoing arrangement makes it possible to receive radio waves both in the VHF (88 MHz to 222 MHz) and UHF (470 MHz to 710 MHz) bands that serve as main broadcast bands.

Further, the first and second earphone cables operate as a dipole antenna. When a user puts the first and second earphone cables in his/her ears, a dipole antenna is formed around his/her neck so as to extend in a direction parallel to the ground.

This makes it possible to efficiently receive a UHF horizontally-polarized wave such as a terrestrial digital broadcast wave. Further, as compared with a sleeve antenna that is formed around the torso of the user when the user puts an earphone antenna in his/her ears, reception can be performed at a higher place above the ground. This makes it possible to obtain higher gain.

Further, a broadcasting receiver including such an earphone antenna as described above can receive broadcast waves in a wide frequency range with high sensitivity.

Additional objects, features, and strengths of the present invention will be made clear by the description below. Further, the advantages of the present invention will be evident from the following explanation in reference to the drawings.

BRIEF DESCRIPTION OF THE DRAWINGS

FIG. 2(*b*) is a graph showing band-pass characteristics of the unbalanced/balanced converter.

FIG. 2(*c*) is a graph showing a phase difference in output signals between output terminals port2 and port3 of the unbalanced/balanced converter.

FIG. 4(*b*) is a graph showing band-pass characteristics of the unbalanced/balanced converter.

FIG. 4(*c*) is a graph showing a phase difference in output signals between output terminals port2 and port3 of the unbalanced/balanced converter.

FIG. 5(*b*) is a signal flow diagram showing how a VHF signal flows through the unbalanced/balanced converter.

DESCRIPTION OF THE EMBODIMENTS

Embodiment 1

An embodiment of the present invention will be described below with reference to FIGS. 1 through 6.

(Outline of an Antenna)

Figure 1:
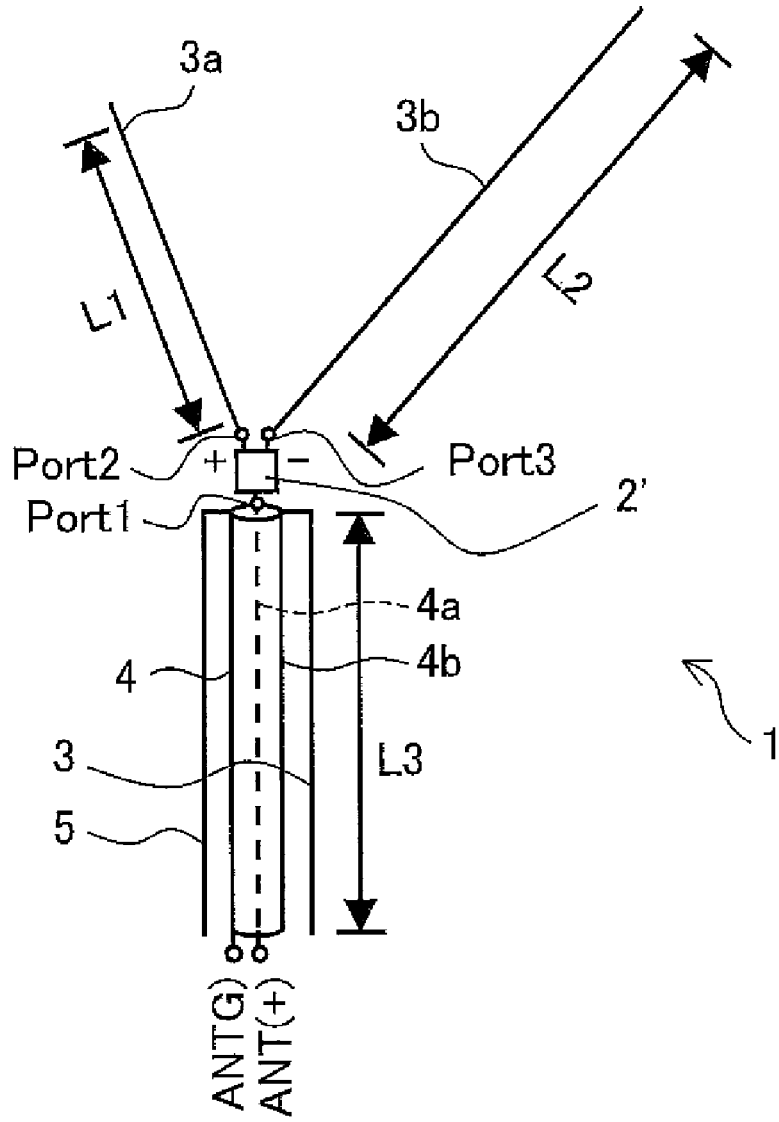
FIG. 1 is a diagram schematically showing an arrangement of an antenna according to an embodiment of the present invention.

FIG. 1 is a diagram schematically showing an antenna 1 of the present embodiment. As showing in FIG. 1, the antenna 1 includes an unbalanced/balanced converter 2, an antenna element (first antenna element) 3*a*, an antenna element (second antenna element) 3*b*, and a coaxial cable (unbalanced power feeder line) 4. The antenna 1 is arranged such that the antenna element 3*a*, the antenna element 3*b*, and the coaxial cable 4 are connected to the unbalanced/balanced converter 2.

The unbalanced/balanced converter 2 includes an input terminal port1 (input port) via which to receive an input unbalanced current and a plurality of output terminals port2 and port3 (first output port, second output port) via which to respectively output electrical currents balanced with each other.

That is, when the input terminal port1 of the unbalanced/balanced converter 2 is fed with unbalanced power, the output terminals port2 and port3 of the unbalanced/balanced converter 2 output electrical currents balanced (equal in amplitude and inverted in phase) with each other. The unbalanced/balanced converter 2 will be fully described later.

The phrase "inverted in phase" used herein refers to a case where the phase difference between the electrical currents is 180 degrees or substantially 180 degrees. Further, the phrase "equal in amplitude" refers to a case where the electrical currents are completely equal in amplitude to each other or where the difference in amplitude between the electrical currents is small.

Each of the antenna elements 3*a* and 3*b* is constituted by a conductor. In FIG. 1, the antenna elements 3*a* and 3*b* have lengths L1 and L2, respectively. The antenna element 3*a* is connected to the output terminal port2 of the unbalanced/balanced converter 2, and the antenna element 3*b* is connected to the output terminal port3 of the unbalanced/balanced converter 2.

The coaxial cable 4 includes a central conductor 4*a*, an insulating layer, and an outer conductor 4*b*. The central conductor 4*a* is covered with the insulating layer, and the insulating layer is covered with the outer conductor 4*b*. In FIG. 1, the coaxial cable 4 has a length L3. The central conductor 4*a* has an end connected to the input terminal port1 of the unbalanced/balanced converter 2, and the other end of the central conductor 4*a* is connected to an antenna input terminal (ANT (+)). The outer conductor 4*b* has an end, facing the unbalanced/balanced converter 2, which is connected to two sleeve elements 5, and the other end of the outer conductor 4*b* is connected to an antenna ground terminal (ANT(G)). Each of the sleeve elements 5 has the same length L3 as the coaxial cable 4.

The connection of the sleeve elements 5 makes it possible to suppress a component, contained in an electrical current flowing through the outer conductor 4*b*, which flows away from the antenna elements. This makes it possible to improve the sensitivity of the antenna 1. The direction in which an electrical current flows through the antenna 1 will be described later.

It should be noted that radio waves can be transmitted and received even in cases where the sleeve elements 5 are omitted. However, in order to increase the transmission and reception sensitivity of the antenna 1, it is preferable that the sleeve elements 5 be connected. Further, in cases where the sleeve elements 5 are not connected to the outer conductor 4*b*, the outer conductor 4*b* may be extended out of the coaxial cable 4 and folded back so as to serve as a sleeve element.

When the antenna 1 transmits and receives a radio wave falling within a VHF band (i.e., a frequency range of substantially 88 MHz to 222 MHz), the antenna element 3*b* and the sleeve elements 5 operate as a sleeve antenna. Moreover, when the antenna 1 transmits and receives a radio wave falling within a UHF band (frequency range of substantially 470 MHz to 710 MHz and a frequency range located thereby), the antenna elements 3*a* and 3*b* operate as a dipole antenna.

The term "frequency range of substantially 88 MHz to 222 MHz" refers to a frequency range of 88 MHz to 222 MHz and a frequency range located thereby, and the term "frequency range of substantially 470 MHz to 710 MHz" refers to a frequency range of 470 MHz to 710 MHz and a frequency range located thereby.

That is, the antenna 1 switches modes of transmission and reception between the time of transmission and reception of a VHF radio wave and the time of transmission and reception of a UHF radio wave. This allows the antenna 1 to realize high transmission and reception sensitivity in both the VHF and UHF bands.

[Lengths of the Antenna Elements and the Length of the Coaxial Cable]

As described above, at the time of transmission and reception of a VHF radio wave, the antenna element 3*b* and the outer conductor 4*b* of the coaxial cable 4 operate as a sleeve antenna in transmitting and receiving the VHF radio wave. Therefore, it is preferable that each of the antenna element 3*b* and the coaxial cable 4 have a length suitable for reception and transmission of a VHF radio wave.

In cases where the effective length of an antenna, i.e., the length of that part of an antenna which actually operates as an antenna is substantially one-quarter wavelength of a radio wave that is to be transmitted and received (lowest-order resonance), the antenna is most efficient in transmission and reception. The phrase "substantially one-quarter wavelength" refers to a length equal to one-quarter wavelength or a length close to one-quarter wavelength.

Therefore, in case of transmission and reception of a radio wave falling within a frequency band, it is preferable that an antenna be constituted by a conductor having a length falling within a range of (i) a length of one-quarter wavelength of the lowest-frequency radio wave in the band to (ii) a length of one-quarter wavelength of the highest-frequency radio wave in the band. In the example shown in the present embodiment, the antenna element 3*a*, the antenna element 3*b*, and the coaxial cable 4 serve as conductors.

Further, in order to efficiently transmit and receive all radio waves falling within a frequency band, it is only necessary that the antenna 1 be formed by (i) a conductor having a length of one-quarter wavelength of the lowest-frequency radio wave in the band and (ii) a conductor having a length of one-quarter wavelength of the highest-frequency radio wave in the band.

For example, the quarter-wavelength of a 100-MHz radio wave is approximately 75 cm, and the quarter-wavelength of a 180-MHz radio wave is approximately 45 cm. Therefore, in case of transmission and reception of radio waves falling within a frequency range of 100 MHz to 180 MHz, it is only necessary that the length L3 of the coaxial cable 4 be approximately 75 cm and the length L2 of the antenna element 3*b* be approximately 45 cm. This makes it possible to efficiently transmit and receive the radio waves falling within the frequency range of 100 MHz to 180 MHz.

Of course, also in cases where the length of the coaxial cable 4 is approximately 45 cm and the length of the antenna element 3*b* is approximately 75 cm, it is possible to efficiently transmit and receive the radio waves falling within the frequency range of 100 MHz to 180 MHz.

Further, for example, in case of reception of an FM radio wave (substantially 75 MHz), the length L3 of the coaxial cable 4 or the length L2 of the antenna element 3*b* only needs to be approximately 100 cm since the quarter-wavelength of a 75-MHz radio wave is approximately 100 cm.

Meanwhile, at the time of transmission and reception of a UHF radio wave, the antenna element 3*a* and the antenna element 3*b* operate as a dipole antenna as described above. Therefore, it is preferable that each of the antenna element 3*a* and the antenna element 3*b* have a length suitable for reception and transmission of a UHF radio wave.

Especially, in order to efficiently receive radio waves falling within the UHF band from the lowest frequency to the highest frequency, it is only necessary that the antenna element 3*b* be made substantially three times as long as the antenna element 3*a*.

For example, the quarter-wavelength of a 500-MHz radio wave is approximately 15 cm, and the quarter-wavelength of a 180-MHz radio wave is approximately 45 cm as described above. Therefore, it is only necessary that the length L1 of the antenna element 3*a* be approximately 15 cm and the length L2 of the antenna element 3*b* be approximately 45 cm. This makes it possible to efficiently transmit and receive radio waves falling within a frequency range of 180 MHz to 500 MHz.

(Unbalanced/balanced Converter)

Figure 2A:
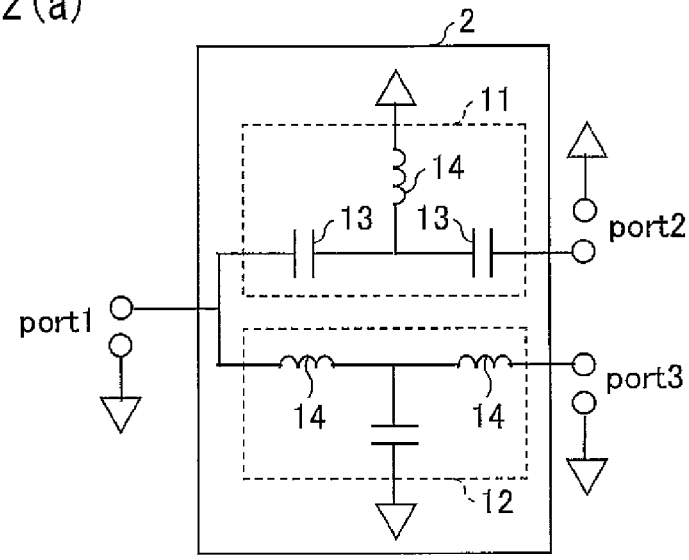
FIG. 2(*a*) is a diagram showing an example of an unbalanced/balanced converter provided in the antenna and schematically showing a circuit arrangement of the unbalanced/balanced converter.
Figure 2B:
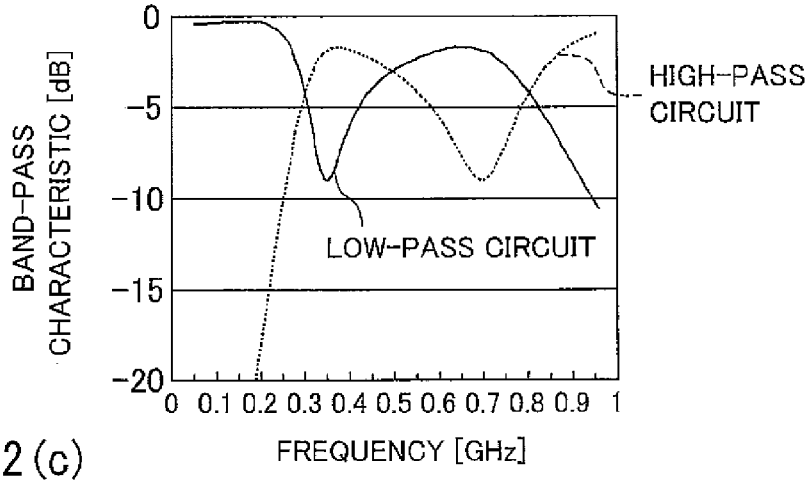
Figure 2C:
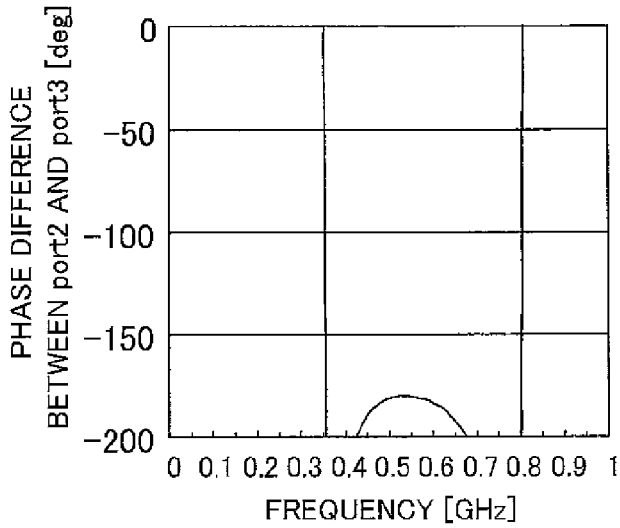

The unbalanced/balance converter 2 will be fully described below with reference to FIGS. 2(*a*), 2(*b*), 2(*c*), and 3. FIG. 2(*a*) is a diagram showing an example of a circuit arrangement of the unbalanced/balance converter 2. As shown in FIG. 2(*a*), the input terminal port1 branches into two in the unbalanced/balance converter 2. One of the branches is connected to the output terminal port2 via a three-stage T-shaped high-pass circuit (first filter circuit) 11 (ladder-shaped high-pass circuit), and the other one of the branches is connected to the output terminal port3 via a three-stage T-shaped low-pass circuit (second filter circuit) 12 (ladder-shaped low-pass circuit).

That is, the high-pass circuit 11 and the low-pass circuit 12 are connected to the input terminal port1 so as to be parallel to each other. The output terminal port2 serves as an output of the high-pass circuit 11, and the output terminal port3 serves as an output of the low-pass circuit 12.

As shown in FIG. 2(*a*), the high-pass circuit 11 includes two capacitors 13 connected in series to each other and an inductor 14 provided between the two capacitors 13. Further, the low-pass circuit 12 includes two inductors 14 connected in series with each other and a capacitor 13 provided between the two inductors 14. In the example shown in FIG. 2(*a*), it is assumed that each of the capacitors 13 has a capacitance of 4 pF (Farad) and each of the inductors 14 has an inductance of 22 nH (Henry).

(Reason Why the Antenna Operates as a Sleeve Antenna at the Time of Transmission and Reception of a VHF Radio Wave)

FIG. 2(*b*) is a graph showing band-pass characteristics of the unbalanced-balanced converter of FIG. 2(*a*). The graph of FIG. 2(*b*) has a horizontal axis that represents frequency (GHz) and a vertical axis on which values (20 log|Sij) obtained by converting a scattering matrix (Sij) into dB (decibel) have been plotted. In FIG. 2(*b*), the solid line represents a band-pass characteristic of the low-pass circuit 12, and the dotted line represents a band-pass characteristic of the high-pass circuit 11.

As shown in FIG. 2(*b*), the high-pass circuit 11 rejects frequencies within a frequency range of substantially not more than 0.3 GHz, and the low-pass circuit 12 rejects frequencies within a frequency range of substantially not less than 0.8 GHz. Therefore, a signal falling within the frequency range of substantially not more than 0.3 GHz can pass though the low-pass circuit 12 but cannot pass through the high-pass circuit 11.

That is, in FIG. 2(*a*), in cases where the input terminal port1 is supplied with a signal having a frequency of not more than 0.3 GHz, the signal cannot pass through the high-pass circuit 11, and therefore is outputted from the output terminal port3 serving as an output terminal of the low-pass circuit 12.

For example, assume that, in cases where the unbalanced/balanced converter 2 of FIG. 2(*a*) is applied to the antenna 1, the antenna input terminal (ANT(+)) and the antenna ground terminal (ANT(G)) are supplied with high-frequency signals each having a frequency of not more than 0.3 GHz.

The high-frequency signal inputted to the antenna input terminal is transmitted to the output terminal port1 of the unbalanced/balanced converter 2 via the central conductor 4*a*. Since the frequency of this high-frequency signal is not more than 0.3 GHz, the high-frequency signal cannot pass through the high-pass circuit 11.

Therefore, the high-frequency signal is not transmitted to the output terminal port2, and is transmitted solely to the output terminal port3. Since the antenna element 3*b* is connected to the output terminal port3, the high-frequency signal is transmitted to the antenna element 3*b*.

Meanwhile, the high-frequency signal inputted to the antenna ground terminal is transmitted to the sleeve elements 5 via the outer conductor 4*b*. This causes electrical currents to flow through the antenna element 3*b* and the sleeve elements 5 in the same direction. As a result, the antenna element 3*b* and the sleeve elements 5 operate as a sleeve antenna.

That is, in cases where the unbalanced/balanced converter 2 of FIG. 2(*a*) is applied to the antenna 1, the antenna element 3*b* and the sleeve elements 5 operate as a sleeve antenna when the antenna 1 transmits and receives a high-frequency signal having a frequency of substantially not more than 0.3 GHz.

(Reason Why the Antenna Operates as a Dipole Antenna at the Time of Transmission and Reception of a UHF Radio Wave)

On the other hand, as shown in FIG. 2(*b*), the high-pass circuit 11 and the low-pass circuit 12 both pass frequencies within a frequency range of substantially 0.45 GHz to 0.55 GHz and a frequency range of substantially 0.75 GHz to 0.9 GHz. Therefore, a signal falling within the frequency range of substantially 0.45 GHz to 0.55 GHz and the frequency range of substantially 0.75 GHz to 0.9 GHz can pass though both the high-pass circuit 11 and the low-pass circuit 12.

That is, in FIG. 2(*a*), in cases where the input terminal port1 is supplied with a signal falling within the frequency range of substantially 0.45 GHz to 0.55 GHz and the frequency range of substantially 0.75 GHz to 0.9 GHz, the signal passes through the high-pass circuit 11 and the low-pass circuit 12, and then is outputted from both the output terminals port2 and port3.

Further, FIG. 2(*c*) is a graph showing a phase difference in output signals between the output terminals port2 and port3 of the unbalanced/balanced converter 2. In the graph of FIG. 2(*c*), the horizontal represents frequency (GHz), and the vertical axis represents phase (deg).

As shown in FIG. 2(*c*), the phase difference in output signals between the output terminals port2 and port3 is substantially 180 degrees in a frequency range of substantially 0.45 GHz to substantially 0.65 GHz. That is, the output signals are inverted in phase with each other.

Therefore, in cases where the unbalanced/balanced converter 2 of FIG. 2(*a*) is applied to the antenna 1, signals respectively outputted from the output terminals port2 and port3 are inverted in phase with each other when the input terminal port1 is supplied with a signal falling within the frequency range of substantially 0.45 GHz to substantially 0.65 GHz.

Further, since there is no change in the amplitude of the signals passing through the high-pass circuit 11 and the low-pass circuit 12, the signals respectively outputted from the output terminals port2 and port3 are equal in amplitude to each other.

For example, assume that, in cases where the unbalanced/balanced converter 2 of FIG. 2(*a*) is applied to the antenna 1, the antenna input terminal (ANT(+)) and the antenna ground terminal (ANT(G)) are supplied with high-frequency signals each having a frequency of substantially 0.45 GHz to 0.6 GHz.

In this case, the high-frequency signal inputted to the input terminal port1 has a frequency of substantially 0.45 GHz to 0.6 GHz, and therefore passes through both the high-pass circuit 11 and the low-pass circuit 12 (see FIG. 2(*b*)). Therefore, the high-frequency signal inputted to the input terminal port1 is outputted to both the output terminals port2 and port3, and then is transmitted to the antenna elements 3*a* and 3*b*.

Further, as shown in FIG. 2(*c*), in cases where the input terminal port1 is supplied with a high-frequency signal having a frequency of substantially 0.45 GHz to 0.6 GHz, the electrical current flowing through the antenna element 3*a* connected to the output terminal port2 and the electrical current flowing through the antenna element 3*b* connected to the output terminal port3 are out of phase by 180 degrees with each other. Further, the electrical current flowing through the antenna element 3*a* and the electrical current flowing through the antenna element 3*b* are equal in amplitude to each other.

As a result, the antenna elements 3*a* and 3*b* operate as a dipole antenna. That is, in cases where the unbalanced/balanced converter 2 of FIG. 2(*a*) is applied to the antenna 1, the antenna elements 3*a* and 3*b* operate as a dipole antenna when the antenna 1 transmits and receives a high-frequency signal having a frequency of substantially 0.45 GHz to 0.6 GHz.

[Gain of the Antenna of the Present Invention]

Figure 3:
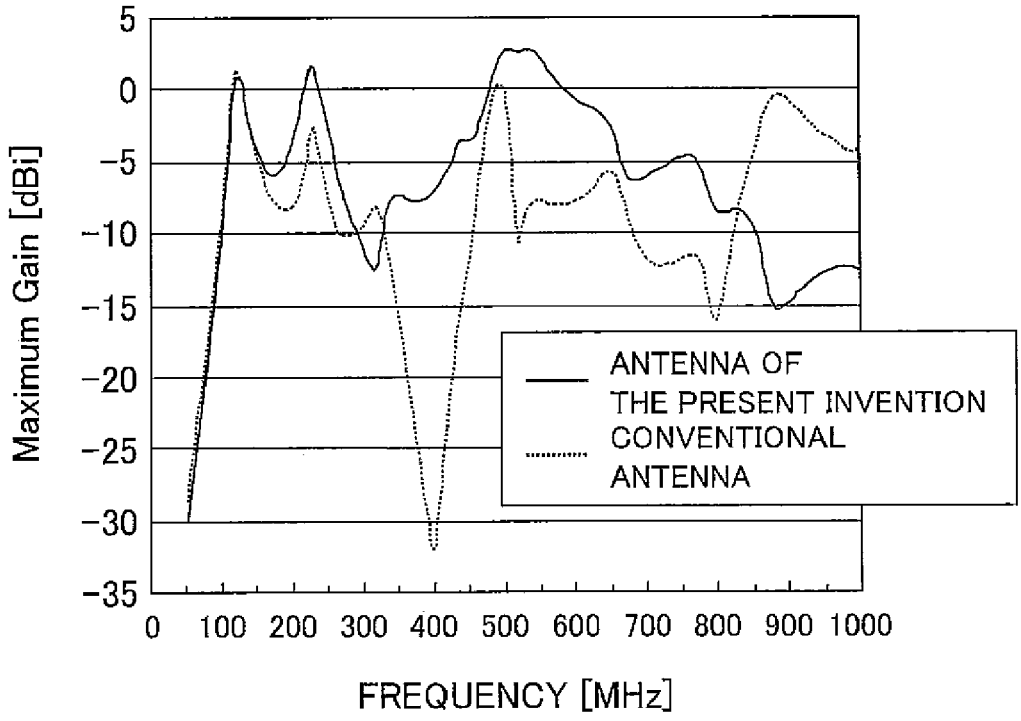
FIG. 3 is a graph showing a frequency characteristic of the maximum gain of an antenna in which the unbalanced/balanced converter is used.

FIG. 3 is a graph showing a frequency characteristic of the maximum gain of the antenna 1 in which the lengths L1, L2, and L3 of the antenna element 3*a*, the antenna element 3*b*, and the coaxial cable 4 are 15 cm, 45 cm, and 75 cm, respectively (see FIG. 1), and in which the unbalanced/balanced converter 2 that has such characteristics as shown in FIG. 2(*b*) is used.

In the graph of FIG. 3, the horizontal axis represents frequency (MHz), and the vertical axis represents maximum gain (dBi). Further, in FIG. 3, the solid line represents a frequency characteristic of the maximum gain of the antenna 1, and the dotted line represents a frequency characteristic of the maximum gain of a conventional antenna for comparison.

The conventional antenna is arranged by removing the unbalanced/balanced converter 2 from the antenna 1 of FIG. 1 and by connecting the antenna elements 3*a* and 3*b* directly to the central conductor 4*a* of the coaxial cable 4.

As shown in FIG. 3, the antenna 1 has higher maximum gain than the conventional antenna both in the VHF (88 MHz to 222 MHz) and UHF (470 MHz to 710 MHz) bands.

One of the reasons why the antenna 1 has higher maximum gain than the conventional antenna in the VHF band is that no electrical current flows through the antenna element 3*a* when the antenna 1 transmits and receives a VHF radio wave. That is, such absence of a current flowing through the antenna element 3*a* at the time of transmission and reception of a VHF radio wave causes the antenna element 3*b* and the sleeve elements 5 to operate as a sleeve antenna. This causes an increase in maximum gain in the VHF band.

On the other hand, in the conventional antenna, electrical currents are distributed to both the antenna elements 3*a* and 3*b*. In cases where electrical currents are distributed to both the antenna elements 3*a* and 3*b*, the electrical currents may flow through the antenna elements 3*a* and 3*b* in directions opposite to each other, depending on how the antenna elements 3*a* and 3*b* are disposed.

In such a case, the electrical current flowing through the antenna element 3*a* and the electrical current flowing through the antenna element 3*b* interfere with each other. This causes a decrease in transmission and reception sensitivity of the sleeve antenna.

That is, to the extent that there is no influence of the interference of the electrical current flowing through the antenna element 3*a*, the antenna 1 of the present invention has higher transmission and reception sensitivity to VHF radio waves than the conventional antenna, and also has higher maximum gain than the conventional antenna.

Further, one of the reasons why the antenna 1 has higher maximum gain than the conventional antenna in the UHF band is that the antenna elements 3*a* and 3*b* operate as a dipole antenna in transmitting and receiving a UHF radio wave.

That is, when the antenna 1 transmits and receives a UHF radio wave, the antenna elements 3*a* and 3*b* resonate with each other. This makes it difficult for the outer conductor 4*b* of the coaxial cable 4 to be excited by a traveling wave.

Generally, an outer conductor of a coaxial cable has a larger surface area than an antenna element, and therefore only suffers from a smaller conductor loss than the antenna element. For this reason, a current component flowing through the outer conductor of the coaxial cable has a significant influence on an electrical current flowing through the antenna element. Therefore, the electrical current flowing through the outer conductor of the coaxial cable undesirably affects the sensitivity of an antenna (traveling-wave excitation).

That is, a comparison between a distribution of leak currents by which the outer conductor 4*b* of the coaxial cable 4 is excited and a distribution of electrical currents by which the antenna elements 3*a* and 3*b* are excited shows that the leak currents are dominant as a current source of the conventional antenna.

On the other hand, in the antenna 1 of the present invention, the antenna elements 3*a* and 3*b* resonate with each other. Therefore, the antenna elements 3*a* and 3*b* become more dominant as a current supply of the antenna 1 than the outer conductor 4*b* of the coaxial cable 4.

Therefore, the antenna 1 of the present invention transmits and receives a UHF radio wave by using the antenna elements 3*a* and 3*b* each set to a length suitable for transmission and reception of a UHF radio wave. This allows the antenna 1 to have higher transmission and reception sensitivity to UHF radio waves than the conventional antenna and to have higher maximum gain than the conventional antenna.

MODIFIED EXAMPLE OF THE UNBALANCED/BALANCED CONVERTER

Figure 4A:
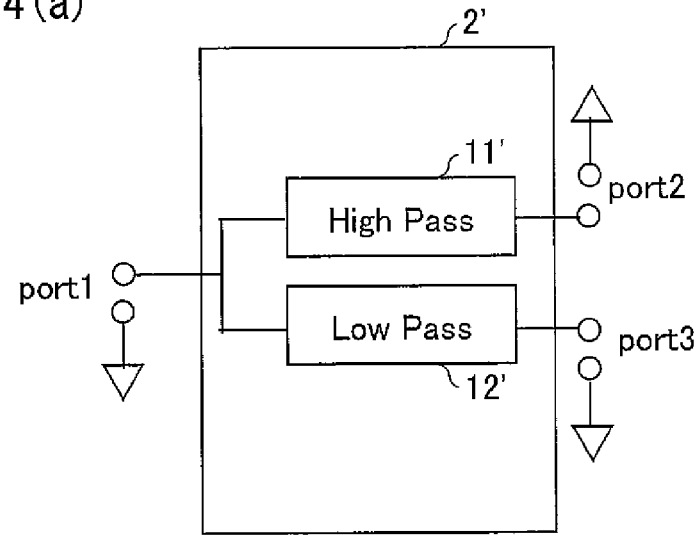
FIG. 4(*a*) is a diagram showing another example of the unbalanced/balanced converter provided in the antenna and schematically showing a circuit arrangement of the unbalanced/balanced converter.
Figure 4B:
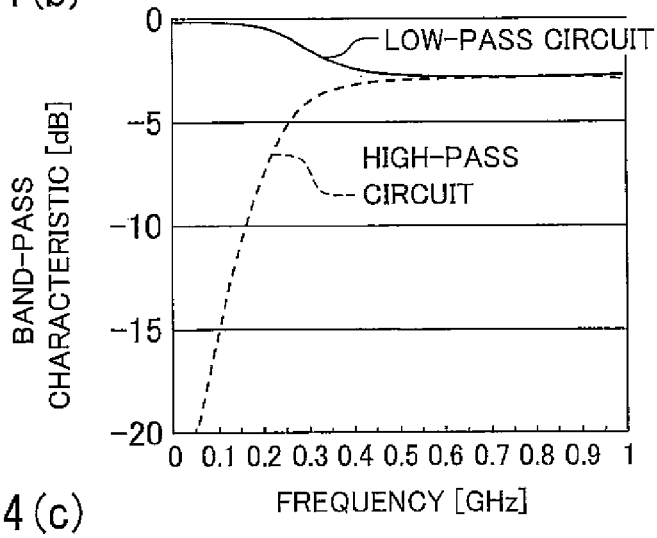
Figure 4C:
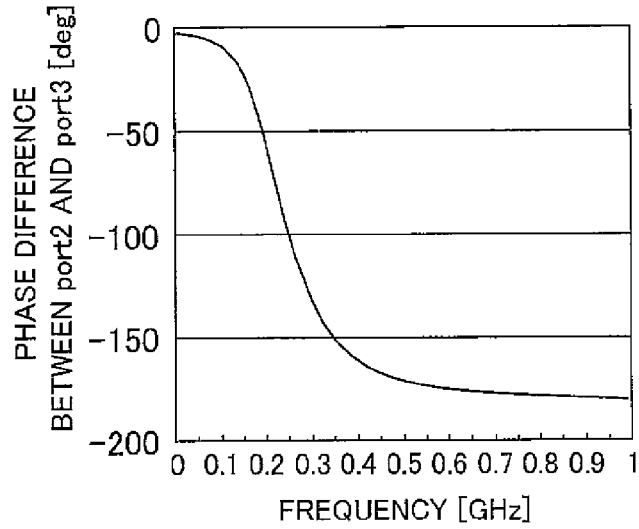

FIG. 4(*a*) is a diagram showing an example of a circuit arrangement of an unbalanced/balanced converter 2' obtained by further widening the bandwidth of the unbalanced/balanced converter of FIG. 2. FIG. 4(*b*) is a graph showing band-pass characteristics of the unbalanced/balanced converter 2'. FIG. 4(*c*) is a graph showing a phase difference in output signals between output terminals port2 and port3 of the unbalanced/balanced converter 2'.

As with the unbalanced/balanced converter 2 of FIG. 2(*a*), the unbalanced/balanced converter 2' of FIG. 4(*a*) has a high-pass circuit 11' and a low-pass circuit 12' that are so connected to an input terminal port1 as to be parallel to each other.

As shown in FIG. 4(*b*), the high-pass circuit 11' rejects frequencies within a frequency range of substantially not more than 0.3 GHz, and the low-pass circuit 12' passes all frequencies within a frequency range of 0 GHz to 1 GHz. Further, the high-pass circuit 11' exhibits a high band-pass characteristic in a band (i.e., a frequency range of substantially 0.6 GHz to 0.8 GHz) in which the high-pass circuit 11 exhibits a low band-pass characteristic in FIG. 2(*b*).

As shown in FIG. 4(*b*), the low-pass circuit 12' passes all frequencies within a frequency range of not more than 1 GHz. That is, the low-pass circuit 12' exhibits a high band-pass characteristic in bands (i.e., a frequency range of substantially 0.3 GHz to 0.5 GHz and a frequency range of substantially not less than 0.8 GHz) in which the low-pass circuit 12 exhibits a low band-pass characteristic in FIG. 2(*b*).

Further, as shown in FIG. 4(*b*), the high-pass circuit 11' and the low-pass circuit 12' are substantially equal in band-pass characteristics to each other in a frequency range of substantially not less than 0.5 GHz.

FIG. 4(*c*) shows a phase difference in output signals between the output terminals port2 and port3 of the unbalanced/balanced converter 2' constituted by the high-pass circuit 11' and the low-pass circuit 12' that have such characteristics. As shown in FIG. 4(*c*), the phase difference in output signals between the output terminals port2 and port3 is substantially 180 degrees in a wide frequency range of substantially 0.5 GHz to 1 GHz.

Figure 5A:
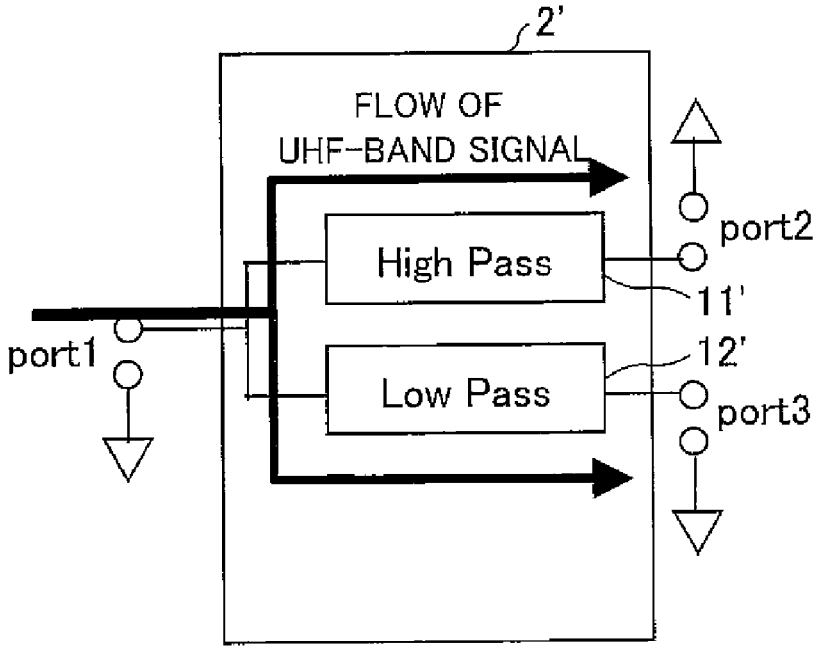
FIG. 5(*a*) is a signal flow diagram showing how a UHF signal flows through the unbalanced/balanced converter.
Figure 5B:
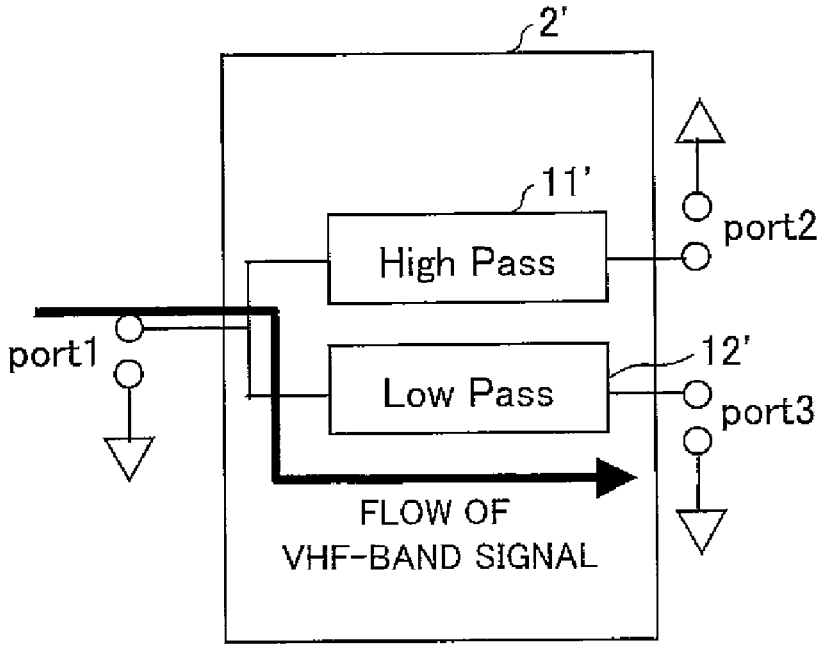

A flow of a signal through the unbalanced/balanced converter 2' will be described below with reference to FIGS. 5(*a*) and 5(*b*). FIG. 5(*a*) is a diagram showing a flow of a UHF signal, and FIG. 5(*b*) is a diagram showing a flow of a VHF signal.

(Flow of a UHF Signal)

In case of transmission and reception of a UHF radio wave, the input terminal port1 is excited by a UHF signal. Here, as shown in FIG. 4(*b*), the high-pass circuit 11' and the low-pass circuit 12' both pass frequencies within a frequency range of substantially not less than 0.4 GHz. Therefore, as shown in FIG. 5(*a*), the UHF signal by which the input terminal port 1 is excited is transmitted to both the output terminals port2 and port3.

Here, as shown in FIG. 4(*c*), the phase difference in output signals between the output terminals port2 and port3 is substantially 180 degrees in a wide frequency range of substantially 0.5 GHz to 1 GHz.

Therefore, in cases where the unbalanced/balanced converter 2' is applied to the antenna 1 of FIG. 1, an input of a UHF signal to the input terminal port1 causes a phase difference of substantially 180 degrees between signals respectively outputted from the output terminals port2 and port3.

Further, since there is no change in the amplitude of the signals passing through the high-pass circuit 11' and the low-pass circuit 12', the signals respectively outputted from the output terminals port2 and port3 are equal in amplitude to each other. Therefore, as with the case where the unbalanced/balanced converter 2 of FIG. 2(*a*) is used, the antenna elements 3*a* and 3*b* operate as a dipole antenna.

(Flow of a VHF Signal)

In case of transmission and reception of a VHF radio wave, the input terminal port1 is excited by a signal having a frequency falling within the VHF band. Here, as shown in FIG. 4(*b*), whereas the low-pass circuit 12' passes frequencies within the VHF band, the high-pass circuit 11' rejects frequencies within a frequency range of not more than 0.3 GHz. Therefore, as shown in FIG. 5(*b*), the VHF signal by which the input terminal port1 is excited is transmitted solely to the output terminal port3.

Therefore, in cases where the unbalanced/balanced converter 2' is applied to the antenna 1 of FIG. 1, a VHF signal inputted to the input terminal port1 is transmitted to the antenna element 3*b* connected to the output terminal port3, but is not transmitted to the antenna element 3*a* connected to the output terminal port2.

As a result, as with the case where the unbalanced/balanced converter 2 of FIG. 2(*a*) is used, the antenna element 3*b* and the sleeve elements 5 operate as a sleeve antenna.

(Comparison with the Unbalanced/balanced Converter 2)

As described above, also in cases where the unbalanced/balanced converter 2' is used, the antenna 1 operates as a sleeve antenna in the VHF band and as a dipole antenna in the UHF band, as with the case where the unbalanced/balanced converter 2 of FIG. 2(*a*) is used.

The unbalanced/balanced converter 2' differs in circuit arrangement from the unbalanced/balanced converter 2 of FIG. 2(*a*) (see FIGS. 2(*a*) and 4(*a*)), and therefore differs in reception sensitivity from the unbalanced/balanced converter 2 of FIG. 2(*a*). That is, the use of the unbalanced/balanced converter 2' allows the antenna 1 to be highly sensitive in a wider frequency range as compared with the case where the unbalanced/balanced converter 2 of FIG. 2(*a*) is used.

The reason for this is as follows: In cases where the unbalanced/balanced converter 2' is used, the antenna 1 operates as a dipole antenna in a wider UHF band. That is, as shown in FIG. 4(*c*), the unbalanced/balanced converter 2' causes a phase difference of substantially 180 degrees between in output signals between the output terminals port2 and port3 in a frequency range of substantially 0.5 GHz to 1 GHz.

On the other hand, as shown in FIG. 2(*c*), the unbalanced/balanced converter 2 of FIG. 2(*a*) causes a phase difference of substantially 180 degrees in output signals between the output terminals port2 and port3 in a frequency range of substantially 0.45 GHz to 0.65 GHz.

That is, the use of the unbalanced/balanced converter 2' of FIG. 4(*a*) causes a phase difference of substantially 180 degrees in output signals between the output terminals port2 and port3 in a wider frequency range as compared with the case where the unbalanced/balanced converter 2 of FIG. 2(*a*) is used.

Therefore, in cases where the antenna 1 is constituted by using the unbalanced/balanced converter 2', the antenna 1 operates as a dipole antenna in a wider UHF band. This allows the antenna 1 to be more highly sensitive in a wider band as compared with the case where the unbalanced/balanced converter 2 of FIG. 2(*a*) is used.

Figure 6:
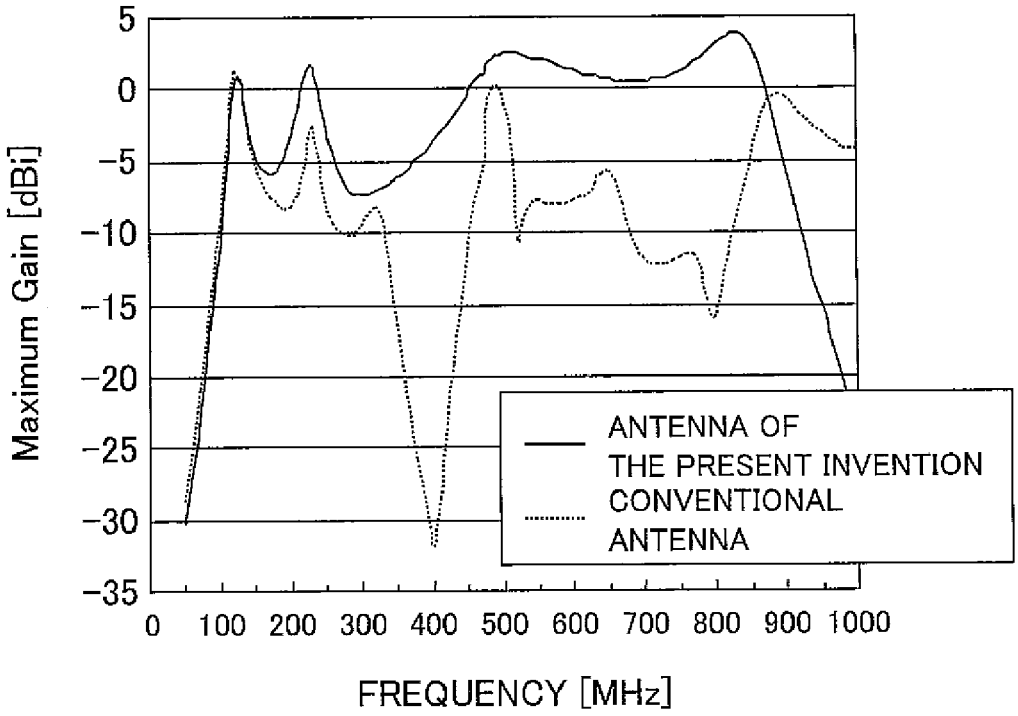
FIG. 6 is a graph showing a frequency characteristic of the maximum gain of an antenna in which the unbalanced/balanced converter is used.

FIG. 6 is a graph showing a frequency characteristic of the maximum gain of the antenna element in which the lengths L1, L2, and L3 of the antenna element 3*a*, the antenna element 3*b*, and the coaxial cable 4 are 15 cm, 45 cm, and 75 cm, respectively (see FIG. 1), and in which the unbalanced/balanced converter 2' that has such characteristics as shown in FIGS. 5(*a*) and (*b*) is used.

In the graph of FIG. 6, as with the graph of FIG. 3, the horizontal axis represents frequency (MHz), and the vertical axis represents maximum gain (dBi). Further, the solid line represents a frequency characteristic of the maximum gain of the antenna 1, and the dotted line represents a frequency characteristic of the maximum gain of a conventional antenna for comparison. The conventional antenna is the same as shown in FIG. 3.

As shown in FIG. 6, the antenna 1 constituted by using the unbalanced/balanced converter 2' has higher maximum gain than the conventional antenna in a frequency range of substantially 200 MHz to 900 MHz. Further, as compared with the case where the unbalanced/balanced converter 2 of FIG. 2(*a*) is used (see FIG. 3), the antenna 1 constituted by using the unbalanced/balanced converter 2' has higher maximum gain in a frequency range of substantially 600 MHz to 900 MHz.

The reason for this is as follows: As described above, whereas the antenna 1 in which the unbalanced/balanced converter 2 of FIG. 2(*a*) is used operates as a dipole antenna in a frequency range of substantially 0.45 GHz to 0.65 GHz, the antenna 1 in which the unbalanced/balanced converter 2' is used operates as a dipole antenna in a frequency range of substantially 0.5 GHz to 1 GHz.

As described above, the antenna 1 operates as a dipole antenna in cases where the phase difference in output signals between the output terminals port2 and port3 is substantially 180 degrees. Therefore, in a band in which high gain needs to be ensured, it is only necessary to use high-pass and low-pass circuits having such band-pass characteristics that the phase difference in output signals between the output terminals port2 and port3 is substantially 180 degrees.

Low-pass and high-pass circuits for use in an unbalanced/balanced converter may be each constituted by a combination of a capacitor, an inductor) and the like, as shown in FIG. 2(*a*), so as to have the desired band-pass characteristics. Alternatively, commercially available low-pass and high-pass circuits may be used.

Embodiment 2

In the present embodiment, an example in which the antenna 1 is applied to an earphone antenna will be described with reference to FIGS. 7 through 10. An earphone antenna 21 of the present invention can be suitably used in such a case that FM, VHF, and UHF radio waves are received with use of a mobile terminal. First, an example arrangement in which the antenna 1 of the present invention is combined with a tripolar earphone will be described with reference to FIG. 7. Components having the same functions as those described in the foregoing embodiment are given the same reference numerals, and will not be described below.

(Arrangement of a Conventional Earphone Antenna)

Figure 14:
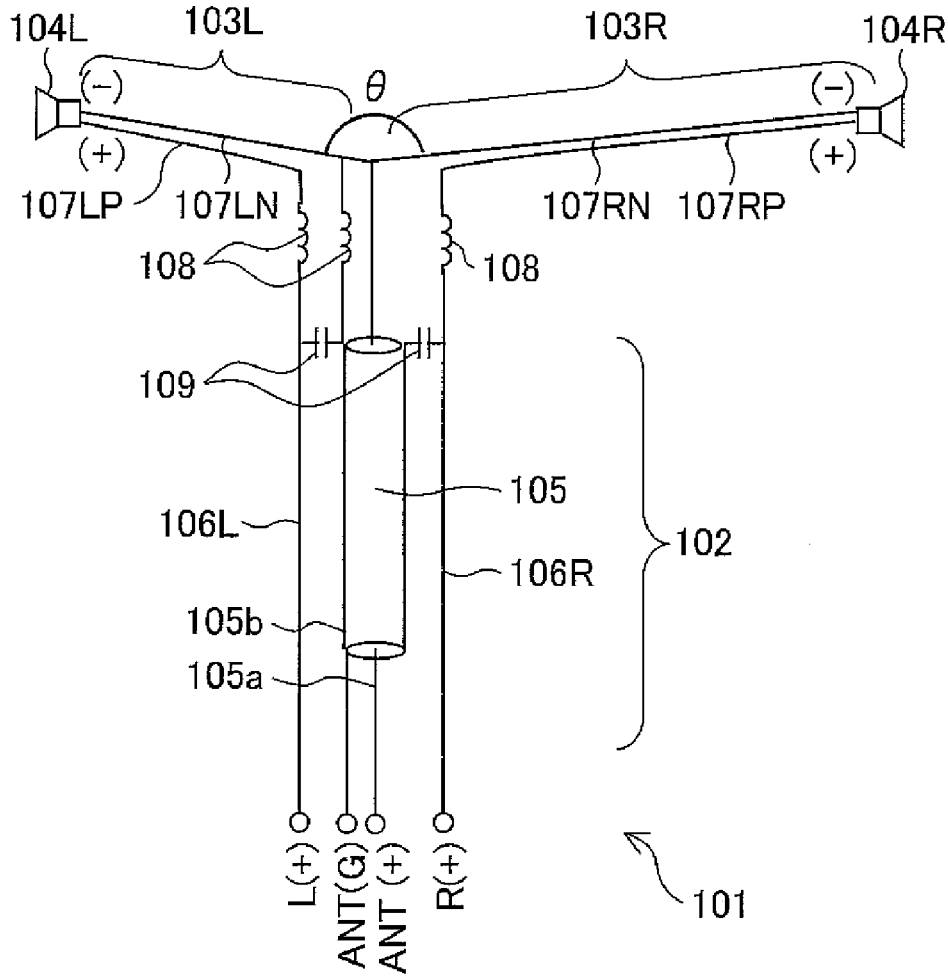
FIG. 14 is a diagram schematically showing an arrangement of a conventional earphone antenna.

First, for comparison with the present invention, a conventional earphone antenna will be described with reference to FIG. 14. FIG. 14 is a diagram schematically showing an arrangement of a conventional earphone antenna 101. As shown in FIG. 14, the earphone antenna 101 includes a feeder cable 102, an earphone cable 103L, an earphone cable 103R, an earphone 104L, and an earphone 104R.

The feeder cable 102 includes a coaxial cable 105, a first audio cable 106L, and a first audio cable 106R. The coaxial cable 105 includes a central conductor 105*a* and an outer conductor 105*b*.

The earphone cable 103L includes a second audio cable 107LP and a second audio cable 107LN, and the earphone cable 103R includes a second audio cable 107RP and a second audio cable 107RN.

The central conductor 105*a* of the coaxial cable 105 has an end connected to an antenna input terminal (ANT(+)), and the other end of the central conductor 105*a* is connected to the second audio cables 107LN and 107RN.

The outer conductor 105*b* of the coaxial cable 105 has an end (facing the antenna input terminal) which is connected to an antenna ground terminal (ANT(G)), and the other end of the outer conductor 105*b* is connected to the second audio cable 107LN via a choke coil 108 and connected to two high-frequency pass capacitors 109.

One of the two high-frequency capacitors connected to the outer conductor 105*b* is connected to the first audio cable 106L and connected to the second audio cable 107LP via a choke coil 108. Similarly, the other one of the high-frequency capacitors is connected to the first audio cable 106R and connected to the second audio cable 107RP via a choke coil 108.

Each of the choke coils 108 has such an inductance as to have high impedance at high frequencies and low impedance at low frequencies. On the other hand, each of the high-frequency pass capacitors 109 has such a characteristic as to have low impedance at high frequencies and high impedance with low frequency signals such as audio signals.

That is, the choke coil 108 blocks a high-frequency signal and passes an audio signal. On the other hand, the high-frequency pass capacitor 109 blocks an audio signal and passes a high-frequency signal.

The following describes how the earphone antenna 101 operates. In cases where the antenna input terminal and the antenna ground terminal are excited by high-frequency signals, the high-frequency signal by which the antenna input terminal is excited passes through the central conductor 105*a*, and then flows to the earphones 104L and 104R via the second audio cables 107LN and 107RN, respectively.

At the same time, the high-frequency signal by which the antenna ground terminal is excited passes through the outer conductor 105*b*, and then flows to the first audio cables 106L and 106R via the high-frequency pass capacitors 109, respectively.

Therefore, in the earphone antenna 101, electrical currents flow through the first audio cables 106L and 106R in the same direction as electrical currents flow through the second audio cables 107LN and 107 RN. As a result, in the earphone antenna 101, the first audio cables 106L and 106R and the second audio cables 107LN and 107 RN operate as a sleeve antenna.

Therefore, in cases where the earphone antenna 101 is used to receive a radio wave falling within a VHF band (88 MHz to 222 MHz), the lengths of the earphone cable 103L, the earphone cable 103R, and the feeder cable 102 only need to be set to be lengths (e.g., approximately 45 cm to 75 cm) suitable for reception of a radio wave falling within a frequency range of 88 MHz to 222 MHz.

In cases where a sleeve antenna that is formed by the earphone antenna 101 is used to receive a 500-MHz (UHF) radio wave, the appropriate lengths of the earphone cables 103L and 103R and the like are approximately 15 cm since the quarter-wavelength of the 500-MHz radio wave is substantially 15 cm.

However, in cases where the lengths of the earphone cables 103L and 103R are 15 cm, the earphone cables 103L and 103R are too short for the size of a person's face This makes it difficult to use the earphone cables 103L and 103R for the earphone antenna 101.

In view of this, a commonly used earphone antenna includes an earphone cable, a coaxial cable, and an audio cable each of which has a length of approximately 37.5 cm, which corresponds to one-quarter wavelength of a VHF-H (200-MHz) radio wave.

Therefore, when such a commonly used earphone antenna is used to receive a UHF radio wave, the high-order resonance of the received radio wave is used, so that the reception sensitivity is reduced as compared with a case where the lowest-order resonance (i.e., the resonance of a conducting wire having a length of one-quarter wavelength of the received radio wave) is used.

Further, in the earphone antenna 101, as the angle θ between the earphone cables 103L and 103R becomes closer to 180 degrees, the angle by which the direction of an electrical current flowing through the earphone cable 103L and the direction of an electrical current flowing through the earphone cable 103R are reversed with respect to each other becomes closer to 180 degrees.

Moreover, the sensitivity of the earphone antenna 101 is reduced as the angle by which the direction of an electrical current flowing through the earphone cable 103L and the direction of an electrical current flowing through the earphone cable 103R are reversed with respect to each other becomes closer to 180 degrees.

(Arrangement of the Earphone Antenna of the Present Invention)

Figure 7:
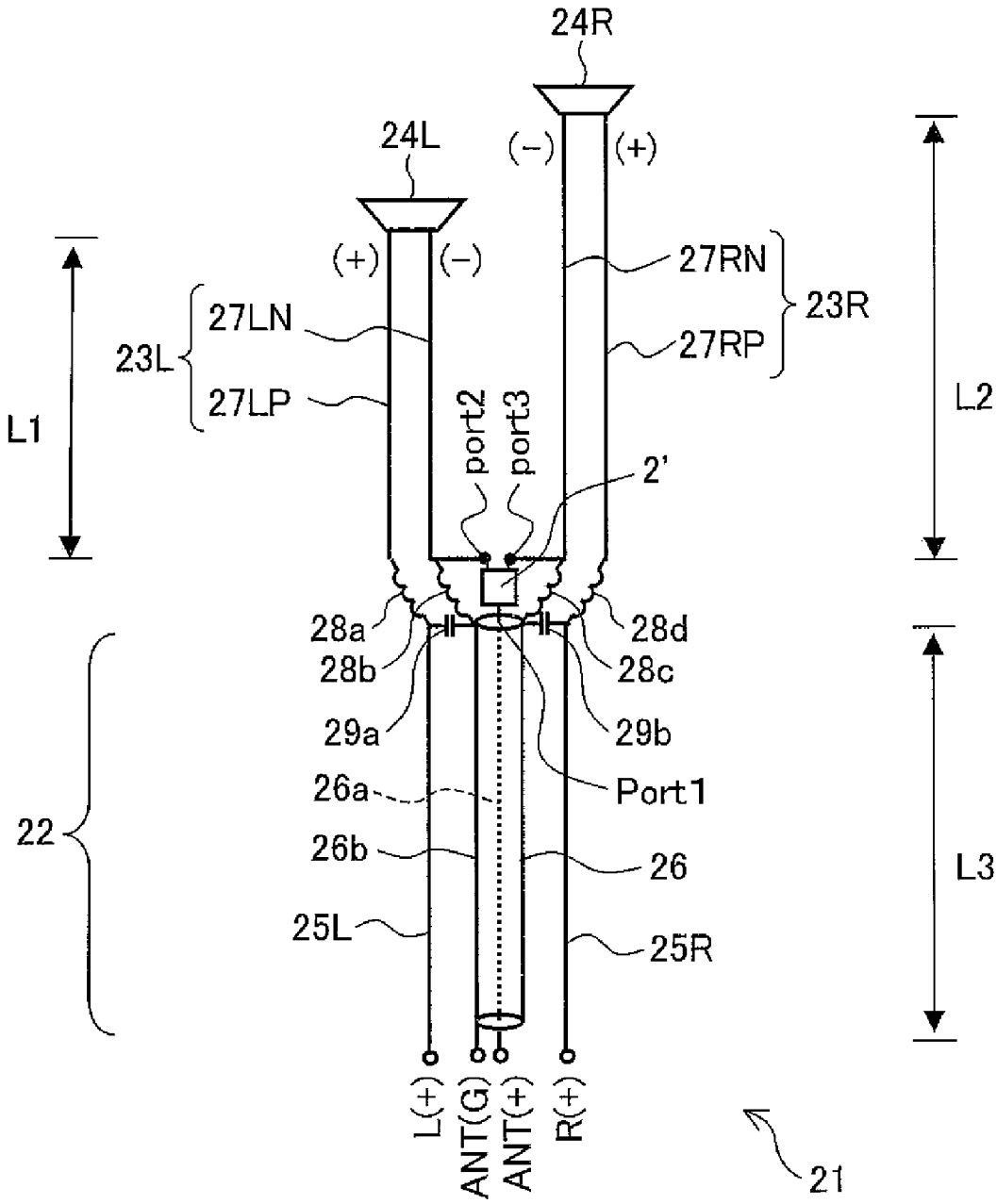
FIG. 7 is a diagram schematically showing an arrangement of an earphone antenna according to an embodiment of the present invention.

The following describes the earphone antenna 21 of the present invention with reference to FIG. 7. FIG. 7 is a diagram schematically showing an arrangement of the earphone antenna 21. As shown in FIG. 7, the earphone antenna 21 includes a feeder cable 22, an unbalanced/balanced converter 2' (see FIGS. 4(*a*) through 6), an earphone cable (first earphone cable) 23L, an earphone cable (second earphone cable) 23R, an earphone (first earphone) 24L, and an earphone (second earphone) 24R.

The feeder cable 22 includes a first audio cable 25L, a first audio cable 25R, and a coaxial cable 26. Although not shown, the feeder cable 22 is arranged such that each of the first audio cable 25R and the coaxial cable 26 is covered with an insulator such as vinyl.

The earphone cable 23L is constituted by a second audio cable 27LP and a second audio cable 27LN. Similarly, the earphone cable 23R is constituted by a second audio cable 27RP and a second audio cable 27RN. As with the feeder cable 22, the earphone cables 23L and 23R are arranged such that each of the cables is covered with an insulator such as vinyl (not shown).

The coaxial cable 26 includes a central conductor 26*a* that has an end connected to an antenna input terminal (ANT(+)), and the other end of the central conductor 26*a* is connected to an input terminal port1 of the unbalanced/balanced converter 2'. The unbalanced/balanced converter 2' has an output terminal port2 connected to the second audio cable 27LN and connected to an outer conductor 26*b* via an inductor 28*b*. Similarly, the unbalanced/balanced converter 2' has an output terminal port3 connected to the second audio cable 27RN and connected to the outer conductor 26*b* via an inductor 28*c*.

The outer conductor 26*b* of the coaxial cable 26 has an end (facing the antenna input terminal) which is connected to an antenna ground terminal (ANT(G)), and the other end of the outer conductor 26*b* is connected to the first audio cable 25L via a capacitor 29*a* and connected to the first audio cable 25R via a capacitor 29*b*. Furthermore, the other end of the outer conductor 26*b* is connected to the output terminal port2 of the unbalanced/balanced converter 2' via the capacitor 29*b* and connected to the output terminal port3 of the unbalanced/balanced converter 2' via the inductor 28*c*.

The output terminal port2 of the unbalanced/balanced converter 2' is connected to the outer conductor 26*b* via an inductor 28*a* and connected to the second audio cable 27LN, and the second audio cable 27LN is connected to a negative terminal (−) of the earphone 24L.

Similarly, the output terminal port3 of the unbalanced/balanced converter 2' is connected to the outer conductor 26*b* via the inductor 28*c* and connected to the second audio cable 27RN, and the second audio cable 27RN is connected to a negative terminal (−) of the earphone 24R.

The first audio cable 25L has an end connected to an audio input terminal L (L(+)), and the other end of the first audio cable 25L is connected to the outer conductor 26*b* of the coaxial cable 26 via the capacitor 29*a* and connected to the second audio cable 27LP via the inductor 28*a*. Moreover, the second audio cable 27LP is connected to a positive terminal (+) of the earphone 24L.

Similarly, the first audio cable 25R has an end connected to an audio input terminal R (R(+)), and the other end of the first audio cable 25R is connected to the outer conductor 26*b* of the coaxial cable 26 via the capacitor 29*b* and connected to the second audio cable 27RP via the inductor 28*d*. Moreover, the second audio cable 27RP is connected to a positive terminal (+) of the earphone 24R.

Each of the inductors 28*a* to 28*d* has such a characteristic as to have low impedance at low frequencies such as frequencies of audio signals and high impedance at high frequencies. Each of the capacitors 29*a* and 29*b* has such a characteristic as to have low impedance at high frequencies and high impedance at low frequencies such as frequencies of audio signals and the like.

That is, each of the inductors 28*a* to 28*d* passes an audio signal, but blocks a high-frequency signal such as a VHF or UHF signal. On the other hand, each of the capacitors 29*a* and 29*b* passes a high-frequency signal such as a VHF or UHF signal, but blocks an audio signal.

(Description of How the Earphone Antenna of the Present Invention Operates)

The following describes how the earphone antenna 21 operates. Described first is an example of how the earphone antenna 21 operates in inputting and outputting an audio signal. The operation of inputting and outputting an audio signal is common to both a case where a VHF radio wave is received and a case where a UHF radio wave is received.

(Operation of Inputting and Outputting an Audio Signal)

The audio input terminals L (L(+)) and R (R(+)) are supplied with stereo audio signals (+). Then, the stereo audio signal (+) inputted to the audio input terminal L is transmitted to the first audio cable 25L, and the stereo audio signal (+) inputted to the audio input terminal R is transmitted to the first audio cable 25R.

The first audio cable 25L has an end (i.e., an to which no audio input terminal is connected) to which the inductor 28*a* and the capacitor 29*a* are connected. An audio signal can pass through the inductor 28*a* but cannot pass through the capacitor 29*a*.

Therefore, the stereo audio signal (+) transmitted to the first audio cable 25L passes through the inductor 28*a*, is supplied to the output terminal (+) of the earphone 24L via the second audio cable 27LP, and then is outputted as a sound from the earphone 24L. Similarly, the stereo audio signal (+) transmitted to the first audio cable 25R passes through the inductor 28*d*, is supplied to the positive terminal (+) of the earphone 24R via the second audio cable 27RP, and then is outputted as a sound from the earphone 24R.

Since the earphone antenna 21 is a tripolar earphone, the antenna ground terminal (ANT(G)) is supplied with a stereo audio signal (−). That is, the earphone antenna 21 is efficiently arranged so as to have a common ground terminal serving both as an audio signal ground terminal and an antenna ground terminal.

The stereo audio signal (−) inputted to the antenna ground terminal is transmitted to the second audio cable 27LN via the outer conductor 26*b* and the inductor 28*b*. Then, the stereo audio signal (−) is supplied to the output terminal (−) of the earphone 24L and then outputted as a sound from the earphone 24L. Similarly, the stereo audio signal (−) is transmitted to the second audio cable 27RN via the outer conductor 26*b* and the inductor 28*c*. Then, the stereo audio signal (−) is supplied to the negative terminal (−) of the earphone 24R and then outputted as a sound from the earphone 24R.

(Example of Operation of Receiving a VHF Radio Wave)

The following describes an example of how the earphone antenna 21 operates in receiving a VHF radio wave. In case of reception of a VHF-band radio wave, the antenna input terminal (ANT(+)) is excited by a high-frequency signal having a frequency falling within the VHF band. Then, the high-frequency signal is sent to the input terminal port1 of the unbalanced/balanced converter 2' via the central conductor 26*a* of the coaxial cable 26.

As shown in FIG. 5(*b*), the high-pass circuit 11' and the low-pass circuit 12' are connected to the input terminal port1 of the unbalanced/balanced converter 2' so as to be parallel to each other. A VHF-band signal can pass only through the low-pass circuit 12'. Therefore, in this case, the high-frequency signal sent to the input terminal port1 is transmitted only to the output terminal port3.

Further, the output terminal port3 is connected to the second audio cable 27RN and connected to the outer conductor 26*b* via the inductor 28*c*. However, since the inductor 28*c* blocks a high-frequency signal, the high-frequency signal transmitted to the output terminal port3 is sent to the second audio cable 27RN, and then flows through the second audio cable 27RN toward the negative terminal (−) of the earphone 24R.

That is, in case of reception of a VHF radio wave, the antenna input terminal (ANT(+)) and the negative terminal (−) of the earphone 24R are electrically connected, with the result that an electrical current flows from the antenna input terminal (ANT(+)) to the negative terminal (−) of the earphone 24R.

Further, the antenna ground terminal (ANT(G)) is also excited by the high-frequency signal. Then, the high-frequency signal by which the antenna ground terminal (ANT (G)) is excited flows through the outer conductor 26*b*. The outer conductor 26*b* has an end (i.e., an end to which no antenna ground terminal is connected) to which the inductors 28*b* and 28*c* and the capacitors 29*a* and 29*b* are connected.

Since the inductors 28*b* and 28*c* block a high-frequency signal, the high-frequency signal by which the antenna ground terminal is excited flows through the capacitor 29*b* toward the first audio cable 25L, and flows to the first audio cable 25R via the capacitor 29*b*.

That is, in case of reception of a VHF radio wave, the antenna ground terminal (ANT(G)) and the audio input terminals (L(+), R(+)) are electrically connected, with the result that an electrical current flows from the audio input terminals (L(+), R(+)) to the antenna ground terminal (ANT(G)).

Therefore, in case of reception of a VHF radio wave, electrical currents flow through the first audio cables 25L and 25R in the same direction as an electrical current flows through the second audio cable 27RN. As a result, the first audio cables 25L and 25R and the second audio cable 27RN operate as a sleeve antenna. That is, in the earphone antenna 21, the first audio cables 25L and 25R play a role as sleeve elements.

As described above, when the earphone antenna operates as a sleeve antenna, no electrical current flows through the second audio cable 27LN. Therefore, unlike the conventional earphone antenna 101 of FIG. 14, the sensitivity of the antenna will not be reduced as the angle θ between the earphone cables 103L and 103R becomes closer to 180 degrees.

(Example of Operation of Receiving a UHF Radio Wave)

The following describes an example of how the earphone antenna 21 operates in receiving a UHF radio wave. In case of reception of a UHF radio wave, the antenna input terminal (ANT(+)) is excited by a high-frequency signal having a frequency falling within the UHF band. Then, the high-frequency signal is sent to the input terminal port1 of the unbalanced/balanced converter 2' via the central conductor 26*a* of the coaxial cable 26.

As shown in FIG. 5(*a*), the high-pass circuit 11' and the low-pass circuit 12' are connected to the input terminal port1 of the unbalanced/balanced converter 2' so as to be parallel to each other. Then, a UHF signal can pass through both the high-pass circuit 11' and the low-pass circuit 12'. Therefore, in this case, the high-frequency signal sent to the input terminal port1 is transmitted to both the output terminals port2 and port3.

Then, the high-frequency signal transmitted to the output terminal port3 flows through the second audio cable 27RN toward the negative terminal (−) of the earphone 24R. Similarly, the high-frequency signal transmitted to the output terminal port2 flows through the second audio cable 27LN toward the negative terminal (−) of the earphone 24L.

As shown in FIG. 4(*c*), the phase difference between the output signals respectively outputted from the output terminals port2 and port3 is substantially 180 degrees in the UHF band, and the output signals respectively outputted from the output terminals port2 and port3 are substantially equal in amplitude to each other.

Therefore, in the earphone antenna 21, the second audio cables 27RN and 27LN operate as a dipole antenna.

Since the earphone antenna 21 operates as an asymmetrical dipole antenna, one of the cables can be lengthened. Therefore, even in cases where one of the cables is lengthened within the scope of practicality, the earphone antenna 21 can be made more sensitive in the UHF band than the conventional earphone antenna.

In the example shown in FIG. 7, the second audio cable 27LN has a length suitable for reception in the UHF band, and the second audio cable 27RN is set to be longer than the second audio cable 27LN. This means that the second audio cable 27RN is longer than a length suitable for reception in the UHF band. However, since the earphone antenna 21 operates as an asymmetrical dipole antenna, the reception sensitivity in the UHF band will not be reduced.

(Summary)

As described above, the earphone antenna 21 operates as a sleeve antenna in receiving a VHF radio wave. Moreover, in this case, the first audio cables 25L and 25R and the second audio cable 27RN form a sleeve antenna. Further, no electrical current flows through the second audio cable 27LN. Therefore, at the time of receiving a VHF radio wave, the earphone antenna 21 can yield higher gain than the conventional earphone antenna.

Further, the earphone antenna 21 operates as a dipole antenna in receiving a UHF radio wave. Therefore, also at the time of receiving a UHF radio wave, the earphone antenna 21 can yield higher gain than the conventional earphone antenna.

That is, the earphone antenna 21 serves as a highly sensitive earphone antenna capable of yielding higher gain both in the VHF and UHF bands than the conventional earphone antenna.

MODIFIED EXAMPLE 1 OF THE EARPHONE ANTENNA

Figure 8:
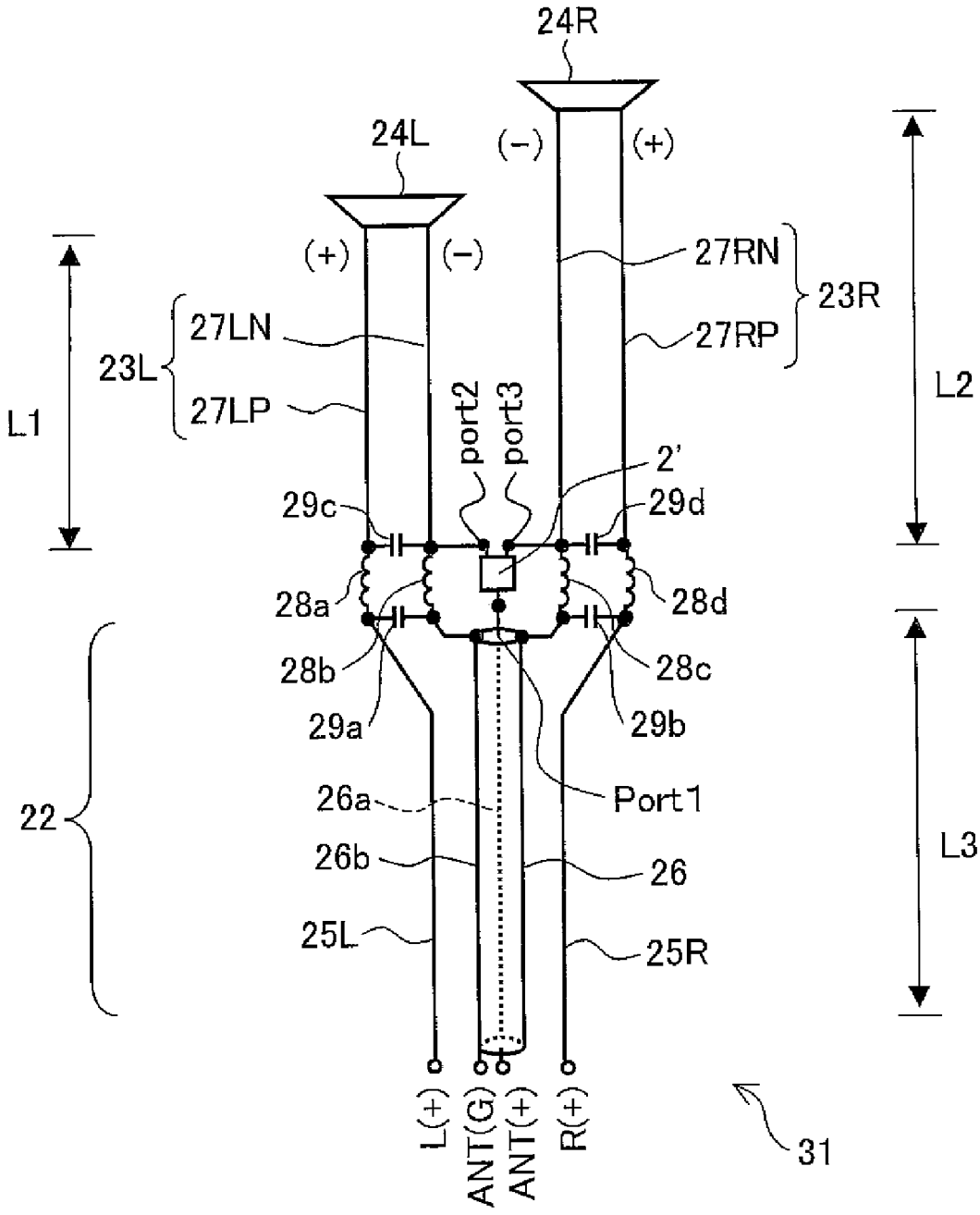
FIG. 8 is a diagram schematically showing a modified example of the earphone antenna according to an embodiment of the present invention.

The following describes a modified example of the earphone antenna 21 with reference to FIG. 8. FIG. 8 is a diagram schematically showing an arrangement of an earphone antenna 31.

The earphone antenna 31 differs from the earphone antenna 21 of FIG. 7 in that the second audio cables 27LN and 27LP have respective ends, facing the unbalanced/balanced converter 2', which are connected to each other via a capacitor (first capacitor) 29*c*, and that the second audio cables 27RN and 27RP have respective ends, facing the unbalanced/balanced converter 2', which are connected to each other via a capacitor (second capacitor) 29*d*.

The provision of the capacitors 29*c* and 29*d* allows the earphone antenna 31 to have higher reception sensitivity than the earphone antenna 21 of FIG. 7.

In cases where the earphone antenna 31 is used to receive a high-frequency signal falling within the VHF band, the high-frequency signal is transmitted to the output terminal port3 of the unbalanced/balanced converter 2' as with the earphone antenna 21 of FIG. 7. The second audio cable 27RN is connected to the output terminal port3, and the second audio cable 27RP is connected to the output terminal port3 via the capacitor 29*d*.

Therefore, the high-frequency signal transmitted to the output terminal port3 of the unbalanced/balanced converter 2' flows through both the second audio cables 27RN and 27RP. Further, electrical currents flow through the second audio cables 27RN and 27RP in the same direction.

Therefore, in ceases where the earphone antenna 31 is used to receive a VHF radio wave, the first audio cables 25L and 25R and the second audio cables 27RN and 27RP operate as a sleeve antenna.

On the other hand, in cases where the earphone antenna 21 of FIG. 7 is used to receive a VHF radio wave, the first audio cables 25L and 25R and the second audio cable 27RN operate as a sleeve antenna.

That is, since the earphone antenna 31 includes the second audio cable 27RP as an additional component of the sleeve antenna, the earphone antenna 31 has higher reception sensitivity in the VHF band than the earphone antenna 21 of FIG. 7.

Similarly, in case of reception of a UHF radio wave, the high-frequency signal transmitted to the output terminal port2 is transmitted to both the second audio cables 27LP and 27RN. Moreover, the high-frequency signal transmitted to the output terminal port3 is transmitted to both the second audio cables 27RP and 27RN.

As described above, the earphone antenna 31 includes the second audio cables 27LP and 27RP as additional components of the dipole antenna. As a result, the earphone antenna 31 has higher reception sensitivity in the UHF band than the earphone antenna 21 of FIG. 7. The earphone antenna 31 operates in the same manner as the earphone antenna 21 of FIG. 7 in inputting and outputting an audio signal. Therefore, the operation of inputting and outputting an audio signal will not be described here.

MODIFIED EXAMPLE 2 OF THE EARPHONE ANTENNA

Figure 9:
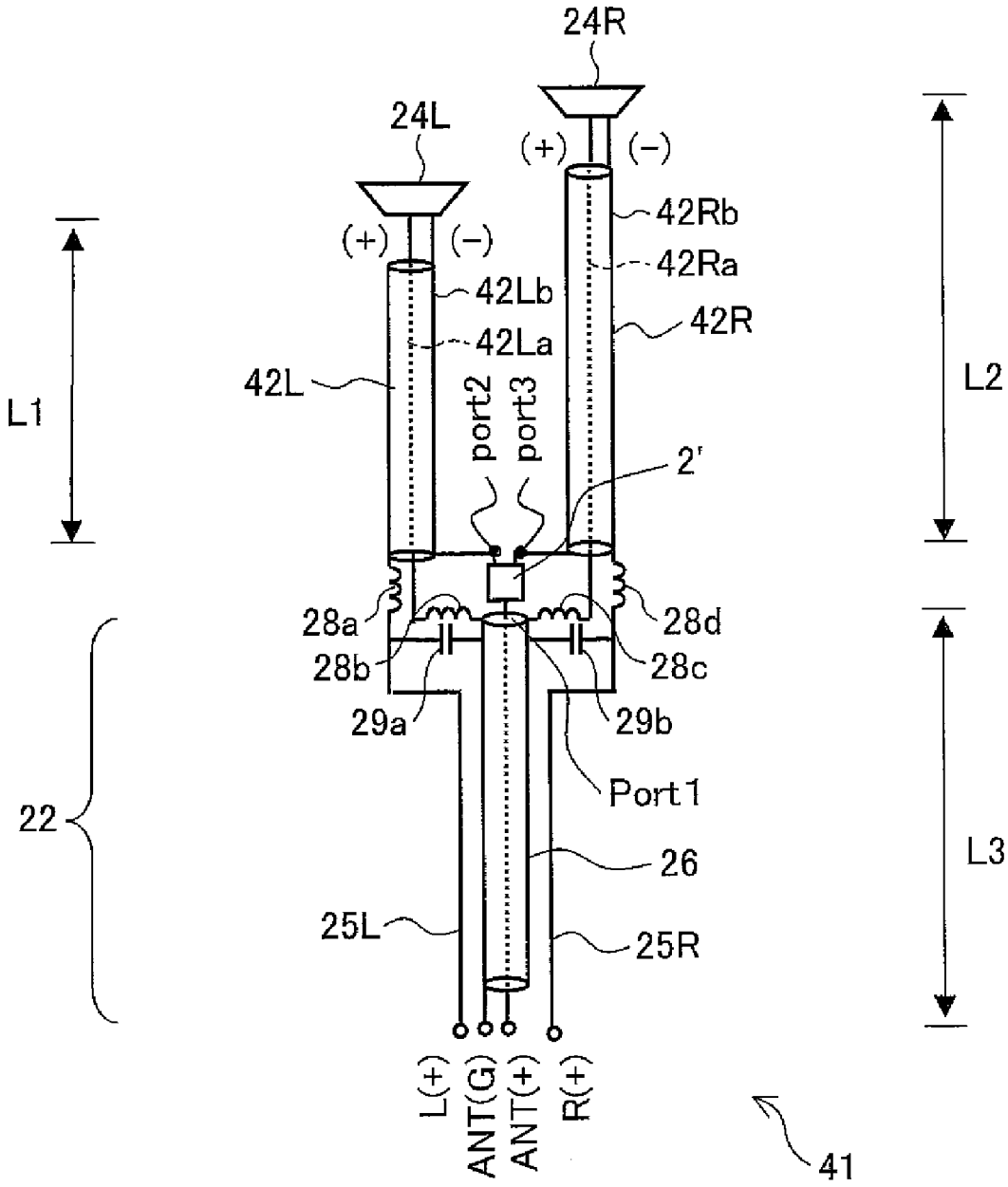
FIG. 9 is a diagram schematically showing another modified example of the earphone antenna according to an embodiment of the present invention.

The following describes another modified example of the earphone antenna with reference to FIG. 9. FIG. 9 is a diagram schematically showing an arrangement of an earphone antenna 41. The earphone antenna 41 is arranged such that the earphone cables 23L and 23R of the earphone antenna 21 of FIG. 7 are respectively replaced by coaxial earphone cables 42L and 42R.

That is, in the earphone antenna 41, the coaxial earphone cable 42L has a central conductor 42La and an outer conductor 42Lb that respectively serve as the second audio cables 27LN and 27LP of the earphone antenna 21 of FIG. 7. The same applies to the coaxial earphone cable 42R.

Therefore, as is the case with the earphone antenna 21 of FIG. 7, in cases where the earphone antenna 41 is used to receive a VHF radio wave, the high-frequency signal by which the central conductor 26*a* of the coaxial cable 26 is excited is transmitted to the output terminal port3, and then flows from the output terminal port3 to the negative terminal (−) of the earphone 24R through an outer conductor 42Rb of the coaxial earphone cable 42R. Further, the high-frequency signal by which the central conductor 26*b* of the coaxial cable 26 is excited is transmitted to the first audio cables 25L and 25R.

This allows an outer conductor 42Rb of the coaxial earphone cable 42R, the first audio cable 25L, and the first audio cable 25R to operate as a sleeve antenna.

Further, as is the case with the earphone antenna 21 of FIG. 7, in cases where the earphone antenna 41 is used to receive a UHF radio wave, the high-frequency signal by which the central conductor 26*a* of the coaxial cable 26 is excited is transmitted to the output terminals port2 and port3. Then, the high-frequency signal flows from the output terminal port2 to the negative terminal (−) of the earphone 24L through the outer conductor 42Lb of the coaxial earphone cable 42L and flows from the output terminal port3 to the negative terminal (−) of the earphone 24R through the outer conductor 42Rb of the coaxial earphone cable 42R.

This allows the outer conductor 42Lb of the coaxial earphone cable 42L and the outer conductor 42Rb of the coaxial earphone cable 42R to operate as a dipole antenna.

The earphone antenna 41 uses the coaxial cable 26 as an earphone cable. This causes a reduction in current density of a high-frequency current flowing through the earphone cable. Therefore, the earphone antenna 41 achieves a reduction in conductor loss. This brings about an improvement in radiation efficiency.

Therefore, the earphone antenna 41 of FIG. 9 has higher reception sensitivity than the earphone antenna 21 of FIG. 7.

Further, as is the case with the earphone antenna 31 of FIG. 8, there may be disposed a capacitor 29 between the outer and central conductors of each of the coaxial cables 42L and 42R. This makes it possible to further increase the reception sensitivity of the earphone antenna 41.

MODIFIED EXAMPLE 3 OF THE EARPHONE ANTENNA

Figure 10:
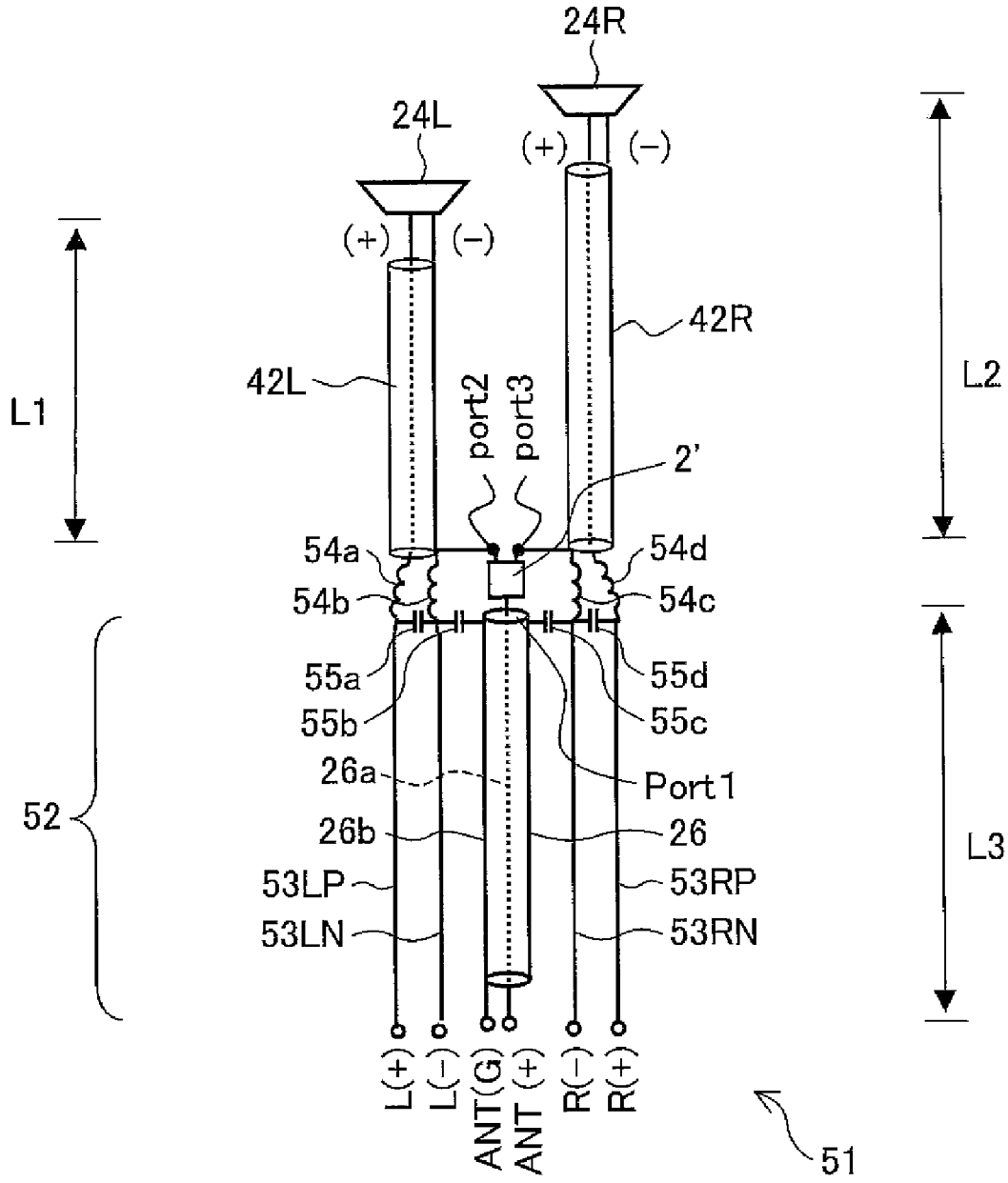
FIG. 10 is a diagram schematically showing still another modified example of the earphone antenna according to an embodiment of the present invention.

The following describes still another modified example of the earphone antenna with reference to FIG. 10.

FIG. 10 is a diagram schematically showing an arrangement of an earphone antenna 51. The earphone antenna 51 is arranged by enabling the earphone antenna 41 to deal with a differential audio signal.

As shown in FIG. 10, the earphone antenna 51 includes a feeder cable 52 instead of the feeder cable of the earphone antenna 41. Such a replacement by the feeder cable 52 causes a change in the way the coaxial earphone cables 42L and 42R and the feeder cable are connected.

The feeder cable 52 is constituted by a coaxial cable 26, a first audio cable 53LP, a first audio cable 53LN, a first audio cable 53RP, and a first audio cable 53RN.

As shown in FIG. 10, the first audio cable 53LP has an end connected to an audio input positive terminal L (L(+)). Further, the other end of the first audio cable 53LP is connected to the central conductor 42La of the coaxial earphone cable 42L via an inductor 54*a* and connected to an end of the first audio cable 53LN via a capacitor (third capacitor) 55*a*.

The inductors 54*a* to 54*d* are identical in characteristics to the inductors 28 shown in FIG. 7 and elsewhere, and the capacitors 55*a* to 55*d* are identical in characteristics to the capacitors 29 shown in FIG. 7 and elsewhere. That is, the inductors 54*a* to 54*d* have such characteristics as to pass an audio signal but block a high-frequency signal. Further, the capacitors 55*a* to 55*d* have such characteristic as to pass a high-frequency signal but block an audio signal.

As described above, the first audio cable 53LN has an end connected to an end of the first audio cable LP via the capacitor 55*a*. Further, the outer conductor 42Lb of the coaxial earphone cable 42 is connected to that end of the first audio cable 53LN via the inductor 54*b*, and the outer conductor 26*b* of the coaxial cable 26 is connected to that end of the first audio cable 53LN via the capacitor 55*b*. Moreover, the other end of the first audio cable 53LN is connected to an audio input negative terminal L (L(−)).

Similarly, the first audio cable 53RP has an end connected to an audio input positive terminal R (R(+)), and the other end of the first audio cable 53RP is connected to the central conductor 42Ra of the coaxial earphone cable 42R via the inductor 54*d* and connected to an end of the first audio cable 53RN via the capacitor (fourth capacitor) 55*d*.

Further, the first audio cable 53RN has an end connected to an end of the first audio cable 53RP via the capacitor 55*d*, connected to the outer conductor 42Rb of the coaxial earphone cable 42R via the inductor 54*c*, and connected to the outer conductor 26*b* of the coaxial cable 26 via the capacitor 55*c*. Moreover, the other end of the first audio cable 53RN is connected to an audio input negative terminal R (R(−)).

(Operation of Inputting and Outputting an Audio Signal)

The following describes how the earphone antenna 51 thus arranged operates in inputting and outputting an audio signal. The audio input positive terminals L (L(+)) and R (R(+)) are supplied with stereo audio signals (+). Then, the stereo audio signal (+) inputted to the audio input positive terminal L (L(+)) is transmitted to the first audio cable 53LP. Meanwhile, the stereo audio signal (+) inputted to the audio input positive terminal R (R(+)) is transmitted to the first audio cable 53RP.

The first audio cable 53LP has an end (i.e., an end to which the audio input positive terminal L (L(+)) is not connected) to which the inductor 54*a* and the capacitor 55*a* are connected. An audio signal can pass through the inductor 54*a* but cannot pass through the capacitor 55*a*.

Therefore, the stereo audio signal (+) transmitted to the first audio cable 53LP is supplied to the positive output terminal (+) of the earphone 24L via the inductor 54*a* and the central conductor 42La of the coaxial earphone cable 42L. Then, the stereo audio signal (+) is outputted as a sound from the earphone 24L.

Similarly, the stereo audio signal (+) transmitted to the first audio cable 53RP is supplied to the positive output terminal (+) of the earphone 24R via the inductor 54*d* and the central conductor 42Ra of the coaxial earphone cable 42R, and then is outputted as a sound from the earphone 24R.

On the other hand, the audio input negative terminals L (L(−)) and R (R(−)) are supplied with stereo audio signals (−). Then, the stereo audio signal (−) inputted to the audio input negative terminal L (L(−)) is transmitted to the first audio cable 53LN, and the stereo audio signal (−) inputted to the audio input negative terminal R (R(−)) is transmitted to the first audio cable 53RN.

The first audio cable 53LN has an end (i.e., an end to which the audio input terminal L(−) is not connected) to which the inductor 54*b* and the capacitors 55*a* and 55*b* are connected. Further, an audio signal can pass through the inductor 54*a* but cannot pass through the capacitors 55*a* and 55*b*.

Therefore, the stereo audio signal (−) transmitted to the first audio cable 53LN is supplied to the output terminal (−) of the earphone 24L via the inductor 54*b* and the outer conductor 42Lb of the coaxial earphone cable 42L. Then, the stereo audio signal (−) is outputted as a sound from the earphone 24L.

Similarly, the stereo audio signal (−) transmitted to the first audio cable 53RN is supplied to the output terminal (−) of the earphone 24R via the inductor 54*c* and the outer conductor 42Rb of the coaxial earphone cable 42R, and then is outputted as a sound from the earphone 24R.

(Example of Operation of Receiving a VHF Radio Wave)

The following describes an example of how the earphone antenna 51 operates in receiving a VHF radio wave. In cases where the earphone antenna 51 is used to receive a VHF radio wave, the antenna input terminal (ANT(+)) is excited by a high-frequency signal. The high-frequency signal is transmitted to the output terminal port3 of the unbalanced/balanced converter 2' through the central conductor 26*a* of the coaxial cable 26. Then, the high-frequency signal transmitted to the output terminal port3 is transmitted to the negative terminal (−) of the earphone 24R through the outer conductor 42Rb of the coaxial earphone cable 42R. That is, the high-frequency signal by which the antenna input terminal is excited is transmitted in the same manner as in the earphone antenna 41 of FIG. 9.

Meanwhile, the high-frequency signal by which the antenna ground terminal (ANT(G)) is excited is transmitted to the first audio cables 53LP, 53LN, 53RP, and 53RN through the capacitors 55*a* and 55*d*.

Therefore, in the earphone antenna 51, electrical currents flow through the first audio cable 53LP, 53LN, 53RP, and 53RN in the same direction as an electrical current flows through the outer conductor 42Rb of the coaxial earphone cable 42R.

As a result, the outer conductor 42Rb of the coaxial earphone cable 42R and the first audio cables 53LP, 53LN, 53RP, and 53RN operate as a sleeve antenna.

A comparison between the earphone antenna 51 and the earphone antenna 41 of FIG. 9 shows that since the earphone antenna 51 additionally includes the first audio cables 53LN and 53RN, the earphone antenna 51 has a larger number of cables that operate as a sleeve antenna.

That is, the number of cables, contained in the feeder cable, which form a sleeve antenna is increased. This makes it possible to suppress an unbalanced current flowing through the coaxial cable 26. As a result, the earphone antenna 51 has higher reception sensitivity in the VHF band than the earphone antenna 41 of FIG. 9.

The earphone antenna 51 operates in the same manner as the earphone antenna 41 of FIG. 9 in inputting and outputting an audio signal. Therefore, the operation of inputting and outputting an audio signal will not be described here.

(Summary)

As described above, the earphone antenna 51 of FIG. 10 can deal with a differential audio signal, and can therefore output as a sound a high-quality audio signal transmitted in the form of a differential audio signal. Further, as compared with the earphone antenna 41 of FIG. 9, the earphone antenna 51 can further suppress an unbalanced current flowing through the coaxial cable 26. Therefore, the earphone cable 51 has higher sensitivity in the VHF band than the earphone antenna 41 of FIG. 9.

Embodiment 3

In the present embodiment, an example of how the earphone antenna of the present invention is applied to a mobile terminal will be described with reference to FIGS. 11 through 13. Components having the same functions as those described in the foregoing embodiment are given the same reference numerals, and will not be described below.

Figure 11:
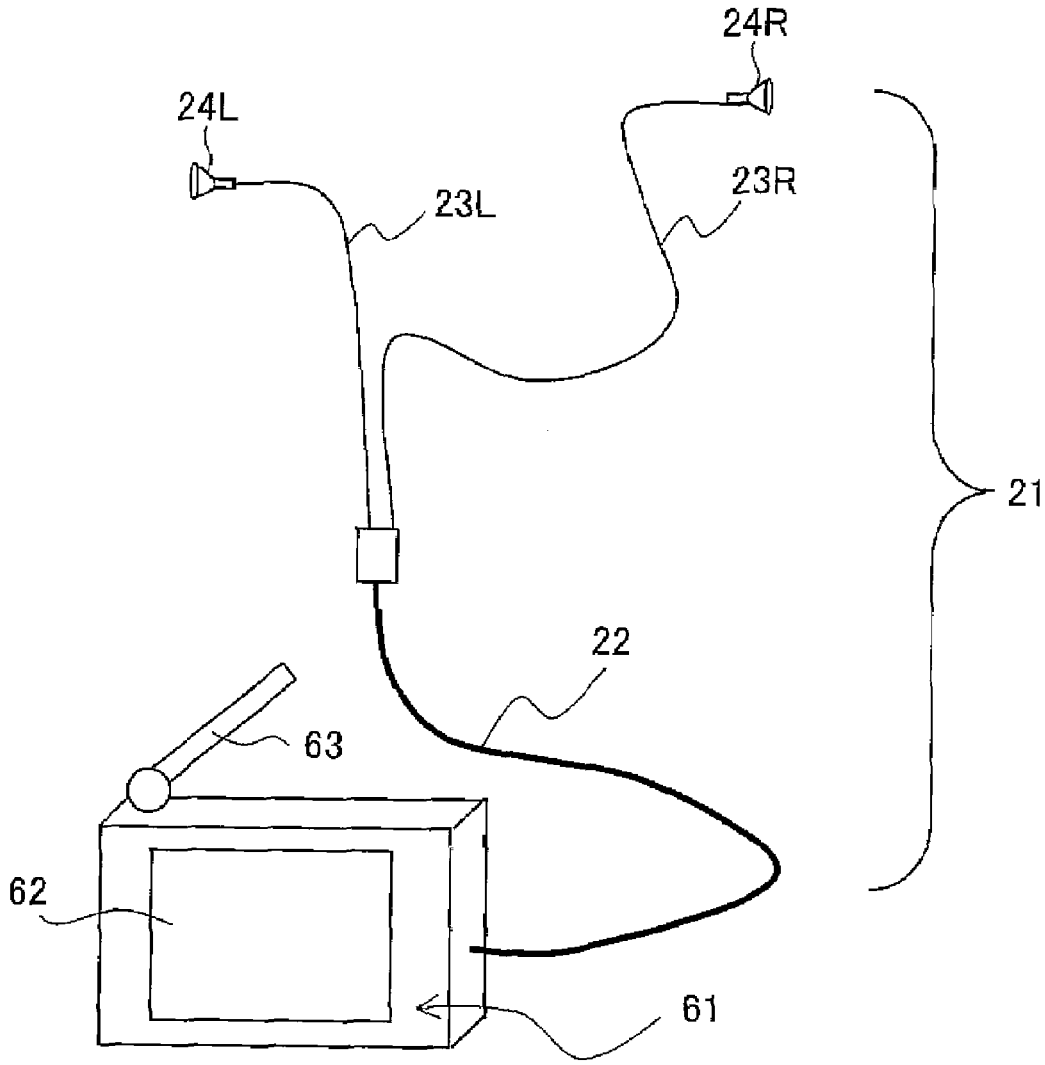
FIG. 11 is a diagram showing an appearance of a mobile terminal according to an embodiment of the present invention.

FIG. 11 is a diagram showing an appearance of a mobile terminal (broadcasting receiver) 61. As shown in FIG. 11, the mobile terminal 61 has an earphone antenna 21 (see FIG. 7) connected thereto. Further, the mobile terminal 61 is provided with a display 62 and a whip antenna 63.

The mobile terminal 61 receives broadcast waves falling within bands such as FM, VHF, and UHF bands, displays images, moving images, text information, and the like in accordance with the received radio waves, and outputs sounds in accordance with the received radio waves.

The display 62 displays an image, a moving image, text information, and the like that have been received by the mobile terminal 61. Specifically, the display 61 can be constituted by a liquid crystal display panel and the like.

The whip antenna 63 serves to receive mainly UHF radio waves. Therefore, it is preferable that the whip antenna 63 have a length of substantially one-quarter wavelength of a wavelength dominant in the UHF band (e.g., substantially 15 cm in cases where the frequency is 500 MHz). The whip antenna 63 may be a publicly known whip antenna.

That is, the mobile terminal 61 includes two types of antenna, namely the earphone antenna 21 and the whip antenna 63. As described above, the whip antenna 63 is used for reception in the UHF band. Therefore, in cases where the mobile terminal 61 is used to receive a broadcast within the VHF band, the broadcast is received by a sleeve antenna that is formed by the second audio cable 27RN contained in the earphone cable 23R and the first audio cables 25L and 25R contained in the feeder cable.

On the other hand, in case of reception of a broadcast within the UHF band, the broadcast may be received by the whip antenna 63 or a dipole antenna that is formed by the second audio cable 27LN contained in the earphone cable 23L and the second audio cable 27RN contained in the earphone cable 23R. Alternatively, the broadcast may be received by a diversity antenna that appropriately switches to the more sensitive one of the whip antenna 63 and the dipole antenna.

Although the earphone antenna connected to the mobile terminal 61 is the earphone antenna 21 of FIG. 7, the earphone antenna connected to the mobile terminal 61 may be any one of the earphone antennas of FIGS. 8 through 10.

(Shadowing)

The use of such an earphone antenna applied to the mobile terminal 61 further brings about an effect of reducing shadowing. This will be described below with reference to FIG. 12. FIG. 12 shows how a UHF broadcast wave (incoming wave) is received by using the mobile terminal 61 to which the earphone antenna has been connected.

Since the mobile terminal 61 is portable, a user of the mobile terminal 61 often views a broadcast by receiving a broadcast wave while moving. Therefore, as shown in FIG. 12, a broadcast wave may come from behind the user. In such a case, the broadcast wave is shielded, which makes it difficult for the broadcast wave to reach the whip antenna 63 (shadowing).

In the earphone antenna 21 connected to the mobile terminal 61, the second audio cable 27RN contained in the earphone cable 23R and the second audio cable 27LN contained in the earphone cable 23L operate as a dipole antenna in receiving a UHF broadcast wave.

Figure 12:
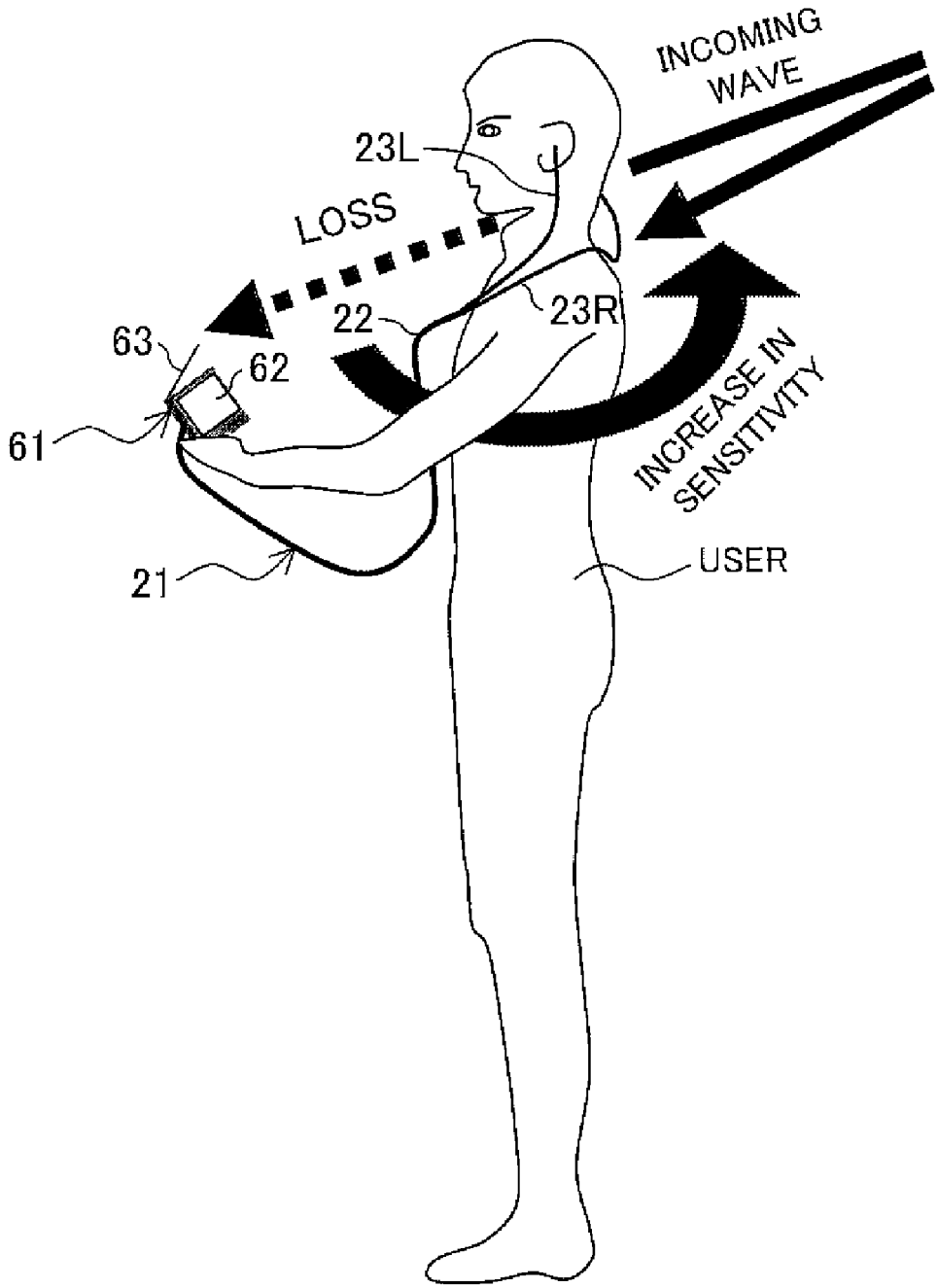
FIG. 12 is a diagram showing how a UHF broadcast wave (incoming wave) is received by using a mobile terminal to which the earphone antenna has been connected.

As shown in FIG. 12, the earphone cables 23R and 23L are located behind the neck of the user. Therefore, a broadcast wave coming from behind the user can be received by a dipole antenna that is formed by the earphone cables 23R and 23L.

[That is, the use of the earphone antenna 21 connected to the mobile terminal 61 prevents shadowing from making it impossible to receive a broadcast wave.

Further, a UHF broadcast wave such as a terrestrial digital broadcast wave is a horizontally-polarized wave. Therefore, when the user puts the earphone antenna 21 in his/her ears as shown in FIG. 12, the broadcast wave can be efficiently received by the earphone cables 23R and 23L located in a direction parallel to the ground.

On the other hand, in cases where such a conventional earphone antenna 101 as shown in FIG. 14 is connected to the mobile terminal 61 to receive a UHF broadcast wave, the broadcast wave is received by a sleeve antenna that is formed by the second audio cable 107LN contained in the earphone cable 103L, the second audio cable 107RN contained in the earphone cable 103R, and the first audio cables 106L and 106R contained in the feeder cable.

Because the sleeve antenna is dominated by the radiation from the first audio cables 106L and 106R contained in the feeder cable 102, it is preferable that the feeder cable be located to be able to receive a broadcast wave. However, as shown in FIG. 12, the feeder cable 102 is located in front of the user. Therefore, in cases where a broadcast wave comes from behind the user, the broadcast wave is shielded. This makes it difficult for the broadcast wave to reach the feeder cable.

Further, as described above, the conventional earphone antenna 101 is arranged such that the earphone cables 103R and 103L and the feeder cable 102 have lengths suitable for reception of a VHF radio wave. Therefore, the use of high-order resonance in reception of a UHF radio wave reduces the sensitivity of the antenna.

Furthermore, as shown in FIG. 12, the sleeve antenna is formed by the earphone cables 103R and 103L and the feeder cable 102 so as to extend in a direction perpendicular to the ground. Therefore, the earphone antenna 101 is highly sensitive to a vertically-polarized wave but has low reception sensitivity to a UHF broadcast wave, such as a terrestrial digital broadcast wave, which is a horizontally-polarized wave.

That is, the conventional earphone antenna 101 can be said to be unsuitable for reception in the UHF band. For example, the difference in UHF reception sensitivity between the earphone antenna 101 of FIG. 14 and the conventional commonly used whip antenna 63 is not less than 5 dB.

As described above, there has conventionally been a difference in reception sensitivity between the earphone antenna 101 and the whip antenna 63. Therefore, in cases where a digital terrestrial broadcast or the like is viewed by the mobile terminal 61 in which the earphone antenna 101 is used, the reception is performed mainly by the whip antenna 63.

Therefore, in cases where a UHF broadcast wave is received by the mobile terminal 61 in which the conventional earphone antenna 101 is used, the whip antenna 63 is shielded by the user from a broadcast wave coming from behind the user. This causes a remarkable reduction in reception sensitivity.

(Height Gain)

Further, one of the advantages of the earphone antenna of the present invention over the conventional earphone antenna is that the earphone antenna of the present invention yields higher height gain than the conventional earphone antenna.

This is described below with reference to FIG. 13. FIG. 13 is a diagram showing the relationship between height above ground and reception sensitivity. It should be noted that the relationship between height above ground and reception sensitivity varies among a rural area, a suburban area, and an urban area. The solid line of FIG. 13 represents the relationship between height above ground in the rural area and reception sensitivity. The dotted line of FIG. 13 represents the relationship between height above ground in the suburban area and reception sensitivity. The dashed line of FIG. 13 represents the relationship between height above ground in the urban area and reception sensitivity.

Figure 13:
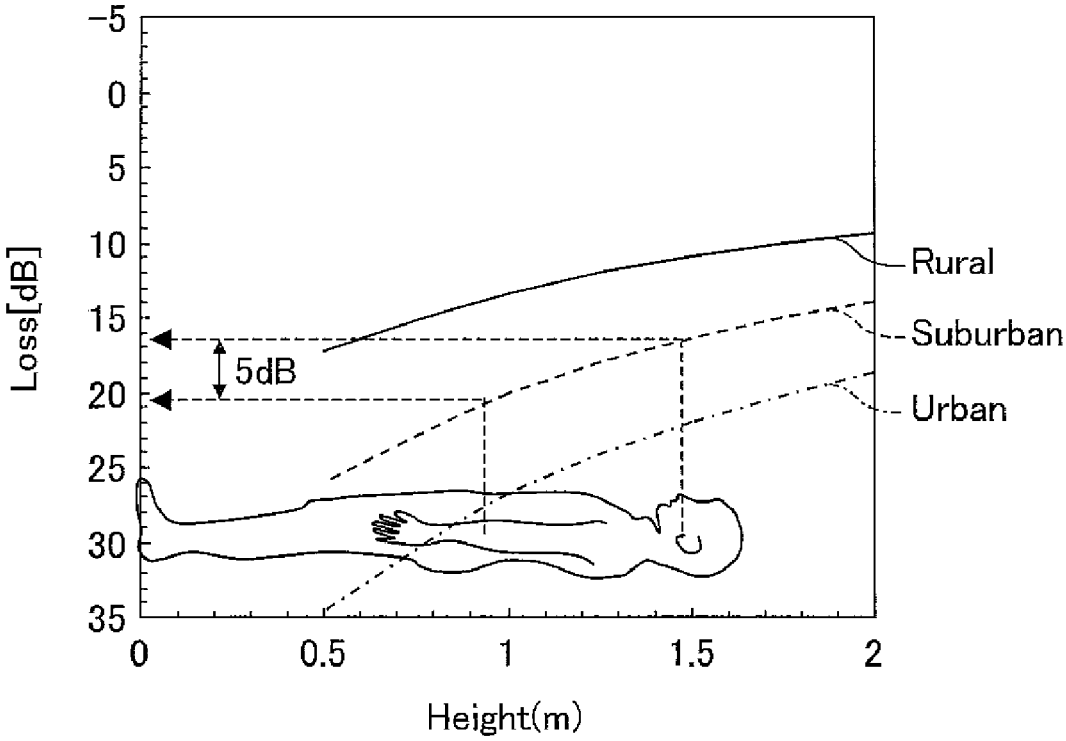
FIG. 13 is a diagram showing the relationship between height above ground and reception sensitivity.

As shown in FIG. 13, the reception sensitivity increases with height above the ground in each of the rural area, the suburban area, and the urban area. That is, the reception sensitivity is improved by reception with use of an antenna located higher above the ground (height gain).

Further, as shown in FIG. 13, the reception sensitivity in the suburban and urban areas where there are a large number of tall buildings and such is lower than the reception sensitivity in the rural area. Therefore, in order to achieve high reception sensitivity especially in the suburban and urban areas, it is necessary to perform reception with use of an antenna located at a higher place.

For example, in cases where reception is performed by an antenna located substantially 1.5 m (i.e., the height of the vicinity of the head of an average adult male) high above the ground in the suburban area as shown in FIG. 13, the reception sensitivity is higher by 5 dB than in cases where reception is performed by an antenna located substantially 1 m (i.e., the height of the vicinity of the waist of an average adult male) high above the ground in the suburban area.

As shown in FIG. 12, the earphone antenna of the present invention performs reception with use of a dipole antenna, formed by the second audio cable 27LN contained in the earphone cable 23L and the second audio cable 27RN contained in the earphone cable 23R, which is located near the head of the user.

On the other hand, the conventional earphone antenna 101 performs reception with use of a sleeve antenna, formed by the first audio cables 106L and 106R contained in the feeder cable 102, which is located near the torso to waist of the user.

That is, the earphone antenna of the present invention can perform reception at a higher place than the conventional earphone antenna. This enables the earphone antenna of the present invention to yield higher height gain than the conventional earphone antenna.

The present invention is not limited to the description of the embodiments above, but may be altered by a skilled person within the scope of the claims. An embodiment based on a proper combination of technical means disclosed in different embodiments is encompassed in the technical scope of the present invention.

As described above, an antenna of the present invention includes: an unbalanced power feeder line; first and second antenna elements; and an unbalanced/balanced converter which includes an input port and first and second output ports, the unbalanced power feeder line being connected to the input port, the first and second antenna elements being connected the first and second output ports, respectively, the unbalanced/balanced converter having a first filter circuit provided between the input port and the first output port and a second filter circuit provided between the input port and the second output port, the first filter circuit rejecting frequencies within a first frequency range, the first and second filter circuits passing frequencies within a second frequency range different from the first frequency range, in response to a signal, inputted to the input port, which falls within the second frequency range, the first and second filter circuits outputting signals that are inverted in phase and equal in amplitude with respect to each other. This brings about an effect of high transmission and reception sensitivity in a wide frequency range.

Further, as described above, an earphone antenna of the present invention includes: a first earphone cable via which an audio signal is supplied to a first earphone; a second earphone cable via which an audio signal is supplied to a second earphone; a feeder cable via which an antenna input signal and an audio signal are supplied to the first and second earphone cables; and an unbalanced/balanced converter which includes an input port and first and second output ports, the unbalanced/balanced converter having a first filter circuit provided between the input port and the first output port and a second filter circuit provided between the input port and the second output port, the first filter circuit rejecting frequencies within a first frequency range, the first and second filter circuits passing frequencies within a second frequency range different from the first frequency range, in response to a signal, inputted to the input port, which falls within the second frequency range, the first and second filter circuits outputting signals that are inverted in phase and equal in amplitude with respect to each other, the feeder cable being connected to the input port, the first earphone cable being connected to the first output port, the second earphone cable being connected to the second output port. This arrangement brings about an effect of high transmission and reception sensitivity in a wide frequency range.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

What is claimed is:

1. An antenna comprising:

an unbalanced power feeder line;

first and second antenna elements; and an unbalanced/balanced converter which includes an input port and first and second output ports, the unbalanced power feeder line being connected to the input port, the first and second antenna elements being connected the first and second output ports, respectively, the unbalanced/balanced converter having a first filter circuit provided between the input port and the first output port and a second filter circuit provided between the input port and the second output port, the first filter circuit rejecting frequencies within a first frequency range, the first and second filter circuits passing frequencies within a second frequency range different from the first frequency range, in response to a signal, inputted to the input port, which falls within the second frequency range, the first and second filter circuits outputting signals that are inverted in phase and equal in amplitude with respect to each other.

2. The antenna as set forth in claim 1, wherein each of the unbalanced power feeder line and the second antenna element has an effective length falling within a range of one-quarter wavelength of a lowest frequency in the first frequency range to one-quarter wavelength of a highest frequency in the first frequency range.

3. The antenna as set forth in claim 1, wherein each of the first and second antenna elements has an effective length falling within a range of one-quarter wavelength of a lowest frequency in the second frequency range to one-quarter wavelength of a highest frequency in the second frequency range.

4. The antenna as set forth in claim 1, wherein while one of the unbalanced power feeder line and the second antenna element has an effective length of one-quarter wavelength of a lowest frequency in the first frequency range, the other one of the unbalanced power feeder line and the second antenna element has an effective length of one-quarter wavelength of a highest frequency in the first frequency range.

5. The antenna as set forth in claim 1, wherein while one of the first and second antenna elements has an effective length of one-quarter wavelength of a highest frequency in the second frequency range, the other one of the first and second antenna elements has an effective length of one-quarter wavelength of a lowest frequency in the second frequency range.

6. An earphone antenna comprising:

a first earphone cable via which an audio signal is supplied to a first earphone;

a second earphone cable via which an audio signal is supplied to a second earphone;

a feeder cable via which an antenna input signal and an audio signal are supplied to the first and second earphone cables; and an unbalanced/balanced converter which includes an input port and first and second output ports, the unbalanced/balanced converter having a first filter circuit provided between the input port and the first output port and a second filter circuit provided between the input port and the second output port, the first filter circuit rejecting frequencies within a first frequency range, the first and second filter circuits passing frequencies within a second frequency range different from the first frequency range, in response to a signal, inputted to the input port, which falls within the second frequency range, the first and second filter circuits outputting signals that are inverted in phase and equal in amplitude with respect to each other, the feeder cable being connected to the input port, the first earphone cable being connected to the first output port, the second earphone cable being connected to the second output port.

7. The earphone antenna as set forth in claim 6, wherein:

while the first earphone cable includes positive and negative signal lines via which an audio signal is supplied to the first earphone, the second earphone cable includes positive and negative signal lines via which an audio signal is supplied to the second earphone; and while the positive and negative signal lines of the first earphone cable are connected to each other via a first capacitor that passes a high-frequency signal and blocks an audio signal, the positive and negative signal lines of the second earphone cable are connected to each other via a second capacitor that passes a high-frequency signal and blocks an audio signal.

8. The earphone antenna as set forth in claim 6, wherein each of the first and second earphone cable is constituted by a coaxial cable.

9. The earphone antenna as set forth in claim 6, wherein:

the feeder cable includes positive and negative signal lines via which an audio signal is supplied to the first earphone cable and positive and negative signal lines via which an audio signal is supplied to the second earphone cable; and while the positive and negative signal lines via which an audio signal is supplied to the first earphone cable are connected to each other via a third capacitor that passes a high-frequency signal and blocks an audio signal, the positive and negative signal lines via which an audio signal is supplied to the second earphone cable are connected to each other via a fourth capacitor that passes a high-frequency signal and blocks an audio signal.

10. The earphone antenna as set forth in claim 6, wherein while the first frequency range is a frequency range of substantially 88 MHz to 222 MHz, the second frequency range is a frequency range of substantially 470 MHz to 710 MHz.

11. A broadcasting receiver comprising an earphone antenna as set forth in claim 6.

* * * * *